US011524270B2

(12) United States Patent
Hurst et al.

(10) Patent No.: US 11,524,270 B2
(45) Date of Patent: Dec. 13, 2022

(54) METHOD OF MIXING A PHARMACEUTICAL SOLUTION AND MIXING SYSTEM

(71) Applicants: BAXTER INTERNATIONAL INC., Deerfield, IL (US); BAXTER HEALTHCARE SA, Glattpark (CH)

(72) Inventors: William Spencer Hurst, Burlington, WI (US); Kent Alan Williams, Chicago, IL (US); Donald A. Smith, Trevor, WI (US); Michael P. Wehrli, Cary, IL (US); Luis Ernesto Criales Escobar, Grayslake, IL (US); Jessica Tam, Chicago, IL (US); Joseph Edward Bigalke, Spring Grove, IL (US); Gert Najdeni, Winnetka, IL (US); Karan Kerwell, Deerfield, IL (US); Lushan Zhou, Ingleside, IL (US); Michael Imeobong Essien, Chicago, IL (US)

(73) Assignees: BAXTER INTERNATIONAL INC., Deerfield, IL (US); BAXTER HEALTHCARE SA, Glattpark (CH)

( * ) Notice: Subject to any disclaimer, the term of this patent is extended or adjusted under 35 U.S.C. 154(b) by 895 days.

(21) Appl. No.: 16/392,074

(22) Filed: Apr. 23, 2019

(65) Prior Publication Data

US 2019/0329196 A1 Oct. 31, 2019

Related U.S. Application Data

(60) Provisional application No. 62/664,005, filed on Apr. 27, 2018.

(51) Int. Cl.
*B01F 33/40* (2022.01)
*B01F 35/513* (2022.01)
(Continued)

(52) U.S. Cl.
CPC ..... *B01F 33/406* (2022.01); *A61J 1/10* (2013.01); *A61J 1/2003* (2015.05); *A61J 1/2037* (2015.05);
(Continued)

(58) Field of Classification Search
CPC A61J 1/10; A61J 1/2003; A61J 1/2037; A61J 1/2082; B01F 21/20; B01F 21/30;
(Continued)

(56) References Cited

U.S. PATENT DOCUMENTS 5,947,596 A 9/1999 Dowd
6,113,793 A 9/2000 Jonsson et al.
(Continued)

FOREIGN PATENT DOCUMENTS

EP 1837640 A2 9/2007
WO WO-2007/089113 A1 8/2007
(Continued)

OTHER PUBLICATIONS

International Application No. PCT/US2019/028686, International Search Report and Written Opinion, dated Sep. 23, 2019.

*Primary Examiner* — David L Sorkin
(74) *Attorney, Agent, or Firm* — Marshall, Gerstein & Borun LLP

(57) ABSTRACT

A method of mixing a pharmaceutical solution including adding a gas into an interior compartment of a mix bag to form a headspace. The interior compartment of the mix bag includes a top portion and a bottom portion. The headspace adjacent to the top portion contains gas. The method includes adding a solvent into the mix bag, and establishing a bubble column in the interior compartment by activating a recirculation assembly. The recirculation assembly includes a connecting pathway operably coupled to a recirculation pump. A first end of the connecting pathway is coupled to a
(Continued)

top gas recirculation port and a second end is coupled to a bottom gas recirculation port of the mix bag such that the recirculation pump draws the gas from the headspace and delivers the gas to the interior compartment via the bottom gas recirculation port. The method includes adding a solute into the mix bag.

24 Claims, 12 Drawing Sheets

(51) Int. Cl.

| | |
|---|---|
| ***A61J 1/10*** | (2006.01) |
| ***A61J 1/20*** | (2006.01) |
| ***B01F 21/20*** | (2022.01) |
| ***B01F 21/00*** | (2022.01) |
| ***B01F 35/00*** | (2022.01) |
| ***B01F 35/71*** | (2022.01) |
| *B01F 101/22* | (2022.01) |

(52) U.S. Cl.
CPC ..... *A61J 1/2082* (2015.05); *B01F 21/20* (2022.01); *B01F 21/30* (2022.01); *B01F 33/401* (2022.01); *B01F 35/187* (2022.01); *B01F 35/513* (2022.01); *B01F 35/7176* (2022.01); *B01F 2101/22* (2022.01)

(58) Field of Classification Search
CPC .... B01F 2101/22; B01F 23/451; B01F 25/53; B01F 33/401; B01F 33/402; B01F 33/406; B01F 35/146; B01F 35/187; B01F 35/513; B01F 35/7176
USPC ..... 366/101, 106; 435/296.1
See application file for complete search history.

(56) References Cited

U.S. PATENT DOCUMENTS

| | | | | |
|---|---|---|---|---|
| 6,149,294 | A | 11/2000 | Jonsson et al. | |
| 6,296,762 | B1 | 10/2001 | Jonsson et al. | |
| 6,361,201 | B1 | 3/2002 | Russell et al. | |
| 6,395,180 | B2 | 5/2002 | Chioini et al. | |
| 6,432,698 | B1 | 8/2002 | Gaugler et al. | |
| 6,537,450 | B2 | 3/2003 | Russell et al. | |
| 6,672,755 | B1 | 1/2004 | Potter et al. | |
| 6,830,367 | B2 | 12/2004 | Peterson et al. | |
| 6,979,427 | B2 | 12/2005 | Sano | |
| 7,384,027 | B2 | 6/2008 | Terentiev et al. | |
| 7,469,884 | B2 | 12/2008 | Terentiev et al. | |
| 7,629,167 | B2 | 12/2009 | Hodge et al. | |
| 7,810,674 | B2 | 10/2010 | Belongia et al. | |
| 7,897,390 | B2 | 3/2011 | Courtois et al. | |
| 8,118,191 | B2 | 2/2012 | Belongia et al. | |
| 8,123,199 | B2 | 2/2012 | Terentiev et al. | |
| 8,343,129 | B2 | 1/2013 | Falkvall et al. | |
| 8,455,242 | B2 | 6/2013 | Staheli et al. | |
| 8,603,805 | B2 | 12/2013 | Goodwin et al. | |
| 8,617,393 | B2 | 12/2013 | Remkes et al. | |
| 8,690,418 | B2 | 4/2014 | Ludwig et al. | |
| 8,753,001 | B2 | 6/2014 | Schauerte et al. | |
| 8,992,070 | B2 | 3/2015 | Kandiyeli et al. | |
| 9,005,971 | B2 | 4/2015 | Goodwin et al. | |
| 9,073,023 | B2 | 7/2015 | Bernard et al. | |
| 9,127,246 | B2 | 9/2015 | Staheli et al. | |
| 9,254,357 | B2 | 2/2016 | Falkvall et al. | |
| 9,259,692 | B2 | 2/2016 | Goodwin et al. | |
| 9,403,134 | B2 | 8/2016 | Fazekas et al. | |
| 9,457,306 | B2 | 10/2016 | Jones et al. | |
| 9,475,012 | B2 | 10/2016 | Goodwin et al. | |
| 9,527,051 | B2 | 12/2016 | Volker | |
| 9,643,133 | B2 | 5/2017 | Goodwin et al. | |
| 9,643,142 | B2 | 5/2017 | Pavlik | |
| 9,682,353 | B2 | 6/2017 | Goodwin et al. | |
| 9,737,861 | B2 | 8/2017 | Volker | |
| 9,744,507 | B2 | 8/2017 | Morrissey et al. | |
| 9,770,696 | B2 | 9/2017 | Terentiev et al. | |
| 9,809,442 | B2 | 11/2017 | Vellutato, Jr. et al. | |
| 9,827,541 | B1 | 11/2017 | Morrissey et al. | |
| 2001/0042717 | A1* | 11/2001 | Chioini | B01F 35/88 210/744 |
| 2004/0245124 | A1* | 12/2004 | Hurst | B65D 77/048 206/219 |
| 2005/0272146 | A1* | 12/2005 | Hodge | B01F 35/513 435/289.1 |
| 2005/0282269 | A1 | 12/2005 | Proulx | |
| 2006/0114744 | A1* | 6/2006 | White | B01F 33/405 366/136 |
| 2006/0196501 | A1* | 9/2006 | Bibbo | C12M 23/14 128/200.23 |
| 2006/0240546 | A1* | 10/2006 | Goodwin | C12M 23/14 435/289.1 |
| 2009/0142827 | A1* | 6/2009 | Schoeb | B01F 33/453 435/302.1 |
| 2010/0112700 | A1 | 5/2010 | Shaaltiel et al. | |
| 2012/0077243 | A1* | 3/2012 | Niazi | C12M 23/26 435/297.1 |
| 2014/0322804 | A1 | 10/2014 | Boily et al. | |
| 2014/0329224 | A1 | 11/2014 | Arnold et al. | |
| 2017/0312413 | A1 | 11/2017 | Fujiwara et al. | |
| 2018/0001281 | A1 | 1/2018 | Skoglund | |
| 2018/0029875 | A1 | 2/2018 | Vellutato, Jr. et al. | |
| 2018/0043322 | A1 | 2/2018 | Morrissey et al. | |
| 2018/0223233 | A1 | 8/2018 | Nanba et al. | |
| 2019/0001290 | A1* | 1/2019 | Fletcher | C12M 41/26 |

FOREIGN PATENT DOCUMENTS

| | | | |
|---|---|---|---|
| WO | WO-2013/158312 | A1 | 10/2013 |
| WO | WO-2016075194 | A1 | 5/2016 |
| WO | WO-2017026199 | A1 | 2/2017 |

* cited by examiner

METHOD OF MIXING A PHARMACEUTICAL SOLUTION AND MIXING SYSTEM

CROSS-REFERENCE TO RELATED APPLICATION

Priority is claimed to U.S. Provisional Patent Application No. 62/664,005, filed Apr. 27, 2018, the entire contents of which are hereby incorporated herein by reference.

FIELD OF DISCLOSURE

This disclosure generally relates to a system and method or process of mixing a pharmaceutical solution, and in particular, a system and method or process of mixing a pharmaceutical solution using bubble agitation.

BACKGROUND

Systems for batch mixing pharmaceutical solutions require a sterile working environment, and require expensive equipment, stringent procedures, and extensive monitoring to ensure that a mix bag of the mixing system and all connections to the mix bag and involved in the system meet certain environmental and manufacturing regulatory standards. Sterilizing a working environment, by itself, can be costly and time consuming. Additional precautions apply for technicians involved in the mixing process to ensure the production of safe and sterile pharmaceutical products. Due to these requirements, mixing systems are often kept in centralized locations, where the pharmaceutical solutions can be made and distributed into product bags, and finally shipped to their destination for use.

Disposable mixing systems have been developed to lower costs of mixing and to increase availability and distribution of these mixing systems. However, mixing in disposable containers is used predominantly in the bioprocessing industry, and these mixing systems generally rely on mechanical means of agitation, such as rotating or reciprocating solid and rigid components inside the single-use container.

SUMMARY

In accordance with a first exemplary aspect of the present disclosure, a bubble agitation system for mixing a pharmaceutical solution is provided. The system may include a mix bag including one or more walls defining an interior chamber having a top portion and a bottom portion opposite the top portion. A top gas recirculation port may extend into the top portion of the interior chamber through the one or more walls of the mix bag. A bottom gas recirculation port may extend into the bottom portion of the interior chamber through the one or more walls of the mix bag. A solvent pathway may be coupled to the interior chamber of the mix bag and may be configured to deliver a solvent into the mix bag. A solute pathway may be coupled to the interior chamber of the mix bag and configured to deliver a solute into the mix bag. A recirculation assembly may include a connecting pathway and a recirculation pump operably coupled to the connecting pathway. The connecting pathway may have a first end coupled to the top gas recirculation port and a second end coupled to the bottom gas recirculation port. The recirculation pump may engage the connecting pathway to pull gas from a headspace disposed adjacent to the top portion of the mix bag and deliver gas through the connecting pathway and into the bottom portion of the mix bag via the bottom gas recirculation port.

In accordance with a second exemplary aspect of the present disclosure, a method of mixing a pharmaceutical solution in a closed system is provided. The method may include adding a gas into an interior compartment of a mix bag to form a headspace, where the mix bag may include one or more walls defining the interior compartment having a top portion and a bottom portion. The headspace may be disposed adjacent to the top portion and containing the gas. The method may include adding a solvent into the interior compartment of the mix bag. Establishing a bubble column in the interior compartment of the mix bag may include activating a recirculation assembly. The recirculation assembly may include a connecting pathway and a recirculation pump operably coupled to the connecting pathway. The connecting pathway may be coupled at a first end to a top gas recirculation port disposed in the top portion of the mix bag and at a second end to a bottom gas recirculation port disposed in the bottom portion of the mix bag such that the recirculation pump draws the gas from the headspace and delivers the gas to the interior compartment via the bottom gas recirculation port. Further, the method may include adding a solute into the interior compartment of the mix bag.

In accordance with a third exemplary aspect of the present disclosure, a disposable mix bag for use in a bubble mixing system is provided. The mix bag may include a walled enclosure defining an interior chamber and including a top wall and a bottom wall opposite the top wall. A bubble discharge port may be formed in the bottom wall of the walled enclosure, and the bubble discharge port may be fluidly coupled to the interior chamber. The mix bag may include a gas intake port formed in the top wall of the walled enclosure and fluidly coupled to the interior chamber. A solute discharge port may be formed in the top wall of the walled enclosure and may be adapted to dispense a solute into the interior chamber. The solute discharge port may be in substantial axial alignment with the bubble discharge port.

In accordance with any one or more of the foregoing first, second, and third exemplary aspects, a method or process of mixing a pharmaceutical solution and a mixing system for mixing a pharmaceutical solution may include any one or more of the following further preferred forms.

In one preferred form of the system, the connecting pathway may be in fluid communication with the headspace via the top gas recirculation port.

In another preferred form, at least one of the connecting pathway and the bottom gas recirculation port may be configured to discharge gas drawn from the headspace into the bottom portion of the mix bag to form a bubble column.

In another preferred form of the system, the interior chamber of the mix bag may include a sterile environment, and the recirculation assembly may be configured to maintain the sterile environment of the interior chamber of the mix bag.

In another preferred form of the system, the recirculation pump may be a peristaltic pump.

In another preferred form of the system, the bottom gas recirculation port may have an inner diameter in a range of approximately 0.20 inches to approximate 0.5 inches.

In another preferred form, the system may include an excipient pathway coupled to the solvent pathway and configured to deliver an excipient into the solvent pathway.

In another preferred form, a second pump may be operably coupled to at least one of the excipient pathway and the solvent pathway.

In another preferred form, the second pump may be configured to deliver the excipient and the solvent into the mix bag.

In another preferred form of the system, the solvent pathway may be coupled to the bottom gas recirculation port, and the second pump may be configured to deliver the excipient and the solvent into the mix bag through the bottom gas recirculation port.

In another preferred form of the system, the mix bag may include a solvent port coupled to the solvent pathway.

In another preferred form, the solvent port may extend into the top portion of the interior chamber and through the one or more walls of the mix bag.

In another preferred form, the second pump may be configured to deliver the excipient and the solvent through the solvent port.

In another preferred form of the system, the recirculation pump of the recirculation assembly may be reversible to pump fluid in a first direction from the bottom portion of the mix bag to the top portion of the mix bag, and may be reversible to pump fluid in a second direction from the top portion of the mix bag to the bottom portion of the mix bag.

In another preferred form, the system may include a valve operably coupled to the bottom gas recirculation port to control fluid flow through the bottom gas recirculation port.

In another preferred form, the valve may be operably coupled to the solvent pathway and the connecting pathway of the recirculation assembly.

In another preferred form, the system may include a solute pump operably coupled to the solute pathway to deliver the solute to the top portion of the interior chamber of the mix bag.

In another preferred form of the system, the solute pathway may be coupled to the connecting pathway.

In another preferred form, the connecting pathway may be configured to deliver the solute into the bag via the top gas recirculation port.

In another preferred form, the system may include a second valve operably coupled to the top gas recirculation port to control fluid flow through the top gas recirculation port.

In another preferred form, when the second valve is in an open position, the connecting pathways may be fluidly coupled to the top gas recirculation port.

In another preferred form of the system, the mix bag may include a solute port coupled to the solute pathway.

In another preferred form, the solute port may extend into the top portion of the interior chamber and through the one or more walls of the mix bag.

In another preferred form of the system, the solute port may be in substantial axial alignment with the bottom gas recirculation port.

In another preferred form, the system may include an air filter coupled to an ambient air pathway.

In another preferred form, the ambient air pathway may be coupled to the connecting pathway of the recirculation assembly.

In another preferred form of the system, the headspace may be defined by the one or more walls of the mix bag and a top layer of a solvent when the solvent is disposed within the interior chamber of the mix bag.

In another preferred form of the system, the one or more walls of the mix bag may be sloped inward forming a tapered bottom.

In another preferred form, the bottom gas recirculation port may be adjacent to the tapered bottom.

In another preferred form, the system may include a drain port extending into the bottom portion of the interior chamber and through the one or more walls of the mix bag.

In another preferred form, the system may include a downstream assembly coupled to the drain port.

In another preferred form, the downstream assembly may include a pump and a filter having a porosity of approximately 0.2 microns.

In another preferred form, the system may include a free-spinning impeller mechanism disposed within the bottom portion of the interior chamber of the mix bag.

In another preferred form, the system may include a movable frame sized to receive the mix bag.

In another preferred form, the method may include operating the recirculation pump in a first direction by pulling the solvent disposed within the interior compartment of the mix bag in the first direction from the bottom portion of the interior compartment of the mix bag and delivering the solvent through the connecting pathway and into the top portion of the mix bag.

In another preferred form, operating the recirculation pump in the first direction may occur before activating the recirculation assembly.

In another preferred form of the method, adding a solute may include operating a second pump to deliver the solute into the mix bag through a solute pathway.

In another preferred form, the solute pathway may be coupled to the connecting pathway of the recirculation assembly and configured to deliver the solute into the mix bag via the top gas recirculation port.

In another preferred form, the method may include discontinuing the operation of the recirculation pump and the second pump, and reversing the direction of the recirculation pump.

In another preferred form of the method, adding a gas into the interior compartment may include drawing ambient air through an air filter coupled to the connecting pathway, and disposing the filtered air into the interior compartment to form the headspace.

In another preferred form of the method, adding the solute may include dispensing the solute directly above the bubble column.

In another preferred form of the method, adding the solute may include dispensing a powdered active pharmaceutical ingredient through a solute port extending into the top portion of the interior compartment and through the one or more walls of the mix bag.

In another preferred form, the solute port may be in substantial axial alignment with the bottom gas recirculation port of the mix bag.

In another preferred form, adding a solvent may include adding the solvent and adding the solute to the interior compartment of the mix bag before establishing the bubble column.

In another preferred form, the method may include discontinuing the recirculation pump to stop the bubble column after the solute and solvent form a homogenous solution within the interior compartment of the mix bag.

In another preferred form of the method, adding a solvent may include opening a valve operably coupled to the bottom gas recirculation port and adding the solvent to the bottom portion of the interior compartment through the bottom gas recirculation port.

In another preferred form, the method may include discontinuing adding the solvent once the solvent reaches a predetermined level in the interior compartment of the mix bag and closing the valve.

In another preferred form, the method may include opening the valve to drain a homogenous solution from the mix bag, and pumping the solution through a filter sterilization system by operating a third pump.

In another preferred form of the mix bag, the interior chamber may define a headspace adjacent to the top wall of the walled enclosure when the headspace contains a gas.

In another preferred form of the mix bag, the gas intake port may be fluidly coupled to the headspace of the interior chamber.

In another preferred form of the mix bag, the gas intake port and the bubble discharge port may be configured to fluidly connect the headspace of the interior chamber with a portion of the interior chamber adjacent the bottom wall.

In another preferred form, the system may include a solute port extending into the top portion of the interior chamber and through the one or more walls of the mix bag.

In another preferred form, the solute port may be coupled to the solute pathway and may be in substantial axial alignment with the bottom gas recirculation port.

In another preferred form, a solvent port may extend into the top portion of the interior chamber and through the one or more walls of the mix bag.

In another preferred form, an excipient pathway may be coupled to the solvent pathway and configured to deliver an excipient into the mix bag.

In another preferred form, the system may include a second pump operably coupled to the excipient pathway and to the solvent pathway.

In another preferred form, the second pump may be configured to deliver the excipient and the solvent through solvent port of the mix bag.

In another preferred form, the system may include a solute port extending into the top portion of the interior chamber and through the one or more walls of the mix bag.

In another preferred form, the solute port may be coupled to the solute pathway and in substantial axial alignment with the bottom gas recirculation port.

In another preferred form, a valve may be configured to fluidly couple the bottom gas recirculation port to the solvent pathway in a first open position and to the connecting pathway in a second open position.

In another preferred form, the solvent pathway may be configured to deliver the solvent through the bottom gas recirculation port into the bottom portion of the interior chamber when the valve is in the first open position.

In another preferred form, the system may include a second pump operably coupled to the solute pathway and configured to pump the solute through the solute pathway.

In another preferred form, a valve may be configured to fluidly couple the solute pathway to the connecting pathway in a first position and fluidly decouple the solute pathway from the connecting pathway in a second position, such that when the valve is in the first position the second pump is operable to cause the solute to reach the mix bag via the solute pathway, the connecting pathway, and the top gas recirculation port.

In another preferred form, the recirculation pump of the recirculation assembly may be reversible to pump solvent in a first direction from the bottom portion of the mix bag to the top portion of the mix bag, and configured to pump gas in a second direction from the top portion of the mix bag to the bottom portion of the mix bag to form a bubble column.

In another preferred form of the method, adding the solute may include dispensing a powder through the solute pathway where the solute pathway may be coupled to a solute port extending into the top portion of the interior chamber and through the one or more walls of the mix bag.

In another preferred form, the solute port may be substantially aligned with the bottom gas recirculation port of the mix bag.

In another preferred form, adding a solvent may include adding the solvent and adding an excipient to the interior compartment of the mix bag before establishing the bubble column.

In another preferred form of the method, adding a solvent to the interior compartment of the mix bag may include fluidly coupling the bottom gas recirculation port to a solvent pathway.

In another preferred form, activating the recirculation assembly may include fluidly decoupling the bottom gas recirculation port from the solvent pathway.

In another preferred form, adding the solute may include dispensing the solute through a solute port substantially above the bubble column.

In another preferred form, the method may include operating the recirculation pump in a first direction before establishing the bubble column.

In another preferred form, the recirculation pump may pull the solvent disposed within the interior compartment of the mix bag in the first direction from the bottom portion of the interior compartment of the mix bag and may deliver the solvent through the connecting pathway and into the top portion of the interior compartment of the mix bag.

Further, in another preferred form, the method may include operating a second pump to deliver the solute to the interior chamber of the mix bag through a solute pathway that may be coupled to the top gas recirculation port via the connecting pathway of the recirculation assembly.

In another preferred form, the method may include discontinuing the operation of the recirculation pump and the second pump, and reversing the direction of the recirculation pump.

Further, in another preferred form, the method may include operating the recirculation pump in a second direction to draw the gas from the headspace of the interior compartment of the mix bag and deliver the gas to the interior compartment of the mix bag through the bottom gas recirculation port of the mix bag.

DETAILED DESCRIPTION

Figure 1A:
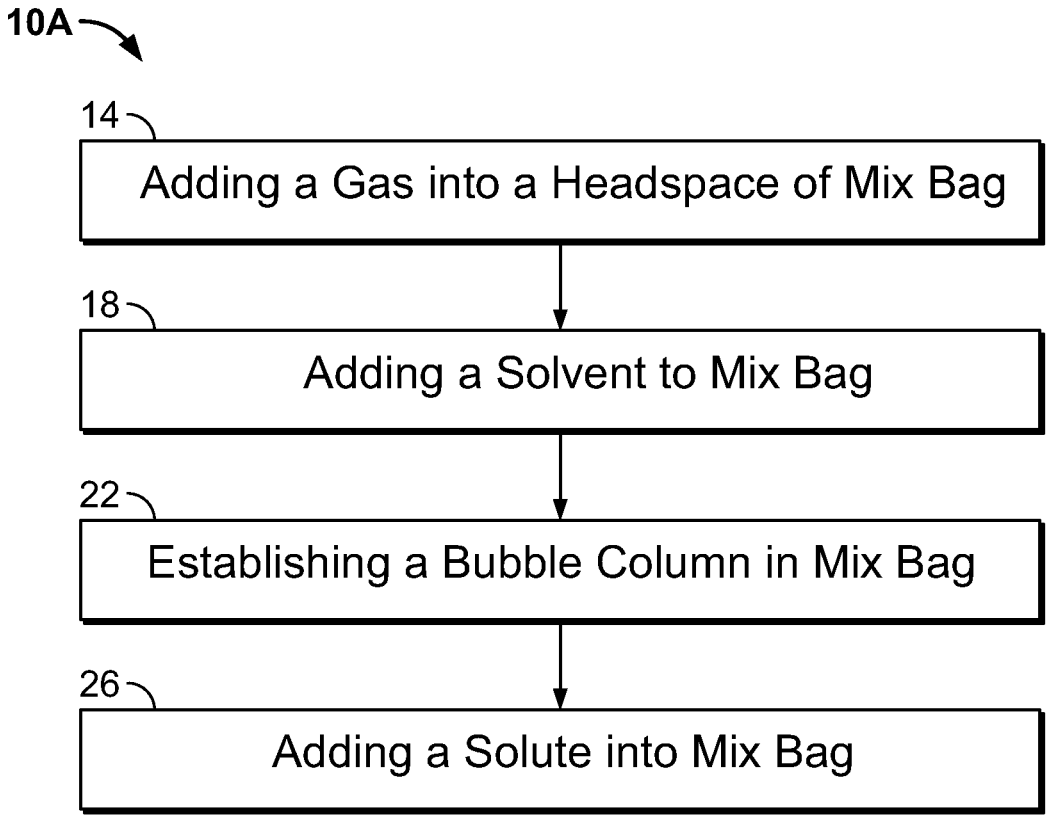
FIG. 1A is a diagram of a first exemplary process or method of mixing a pharmaceutical solution according to the teachings of the present disclosure.
Figure 1B:
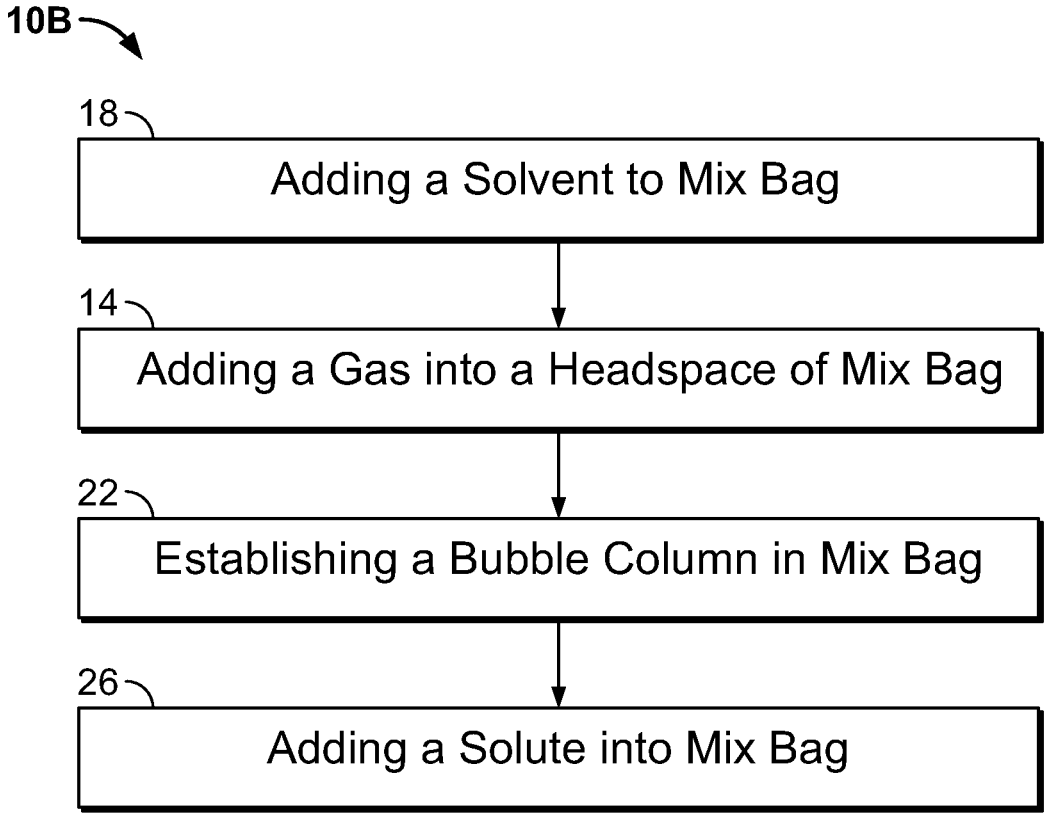
FIG. 1B is a diagram of a second exemplary process or method of mixing a pharmaceutical solution according to the teachings of the present disclosure.
Figure 1C:
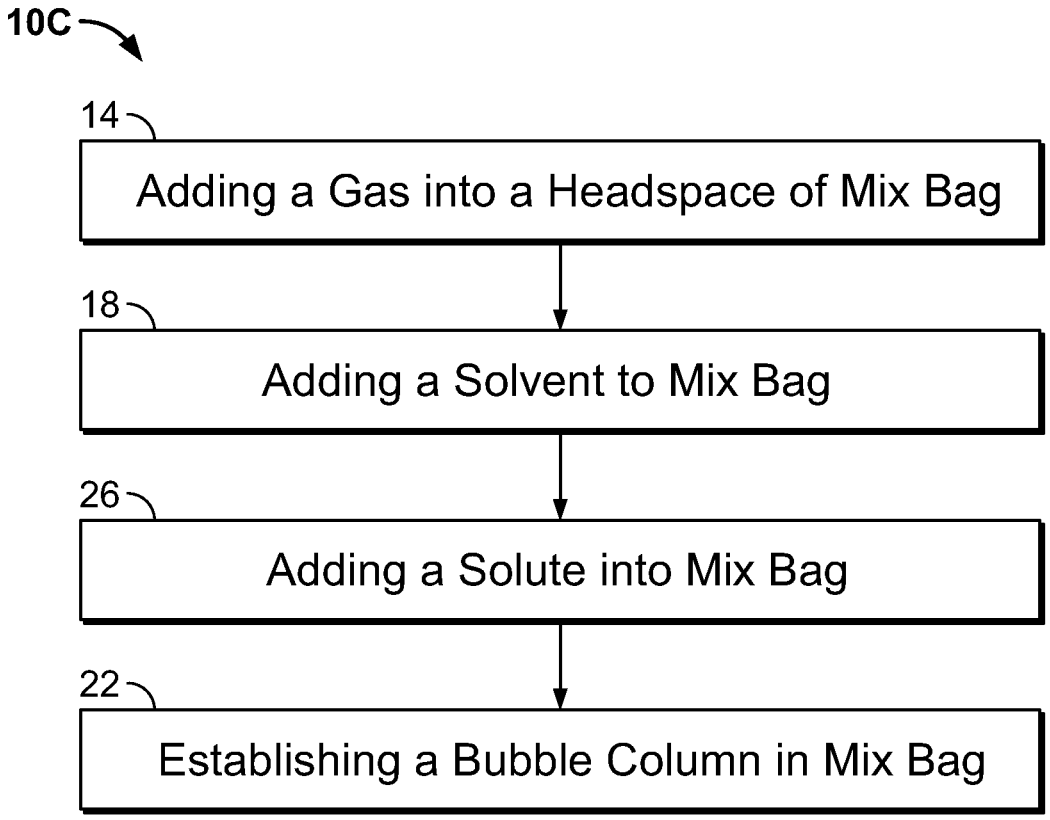
FIG. 1C is a diagram of a third exemplary process or method of mixing a pharmaceutical solution according to the teachings of the present disclosure.
Figure 1D:
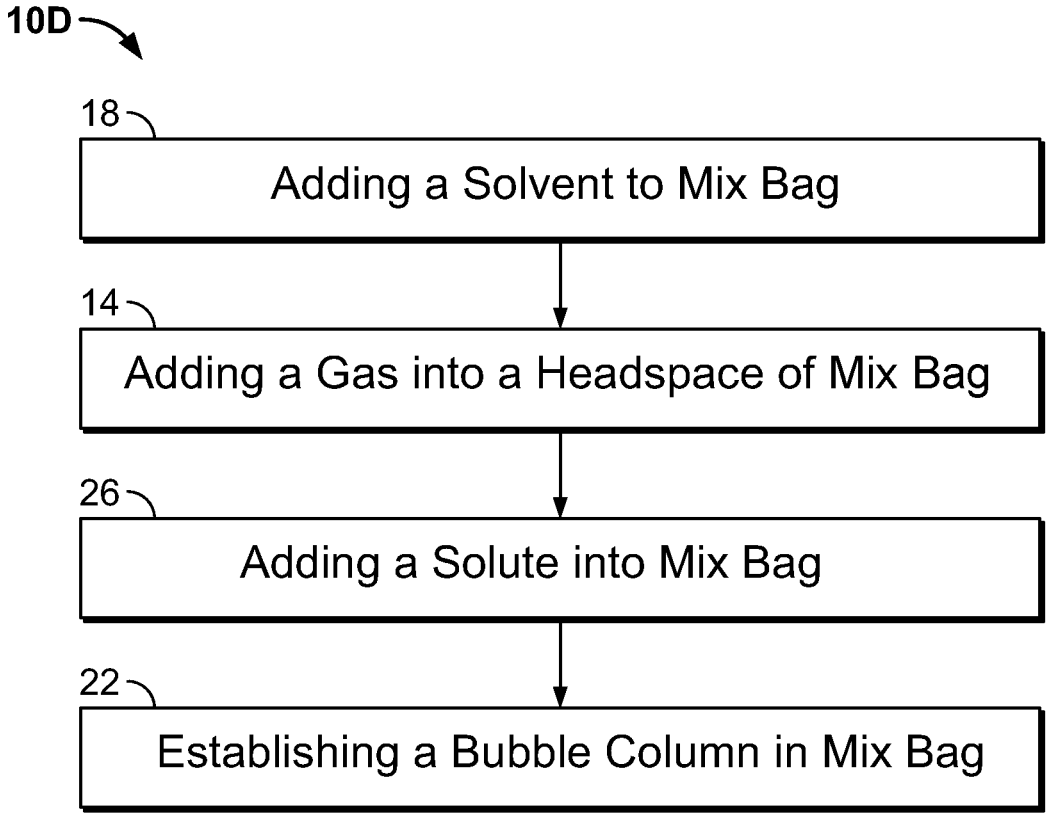
FIG. 1D is a diagram of a fourth exemplary process or method of mixing a pharmaceutical solution according to the teachings of the present disclosure.

The present disclosure relates to local solution manufacturing technology ("LSMT"), and is directed to a system for mixing a pharmaceutical solution and a method of mixing a pharmaceutical solution using bubble agitation. The mixing system and method involves steps of adding a solvent and a solute into a mix bag, and mixing the solvent and solute by bubble agitation to form a pharmaceutical solution. The disclosed mixing system creates a bubble column formed at a bottom of the partially-filled mix bag. The bubble column may entrain and distribute the solute in the rising bubble column and turn over the mixture of solute and solvent within the mix bag to create a homogenous mixture. The system is a closed system, and the components of the system, such as various connecting lines, product and mix bags, etc. may be disposable.

As used herein, "solute" may refer to an additive, a pharmaceutical powder, which may be, for example, an active pharmaceutical ingredient ("API") in powder form or reconstituted in liquid form, a powder or liquid excipient, such as Dextrose or Sodium Chloride, or a component that dissolves in a solvent to form a solution. As used herein, "solvent" may refer to filtered water, filtered water mixed with an excipient, or a medium that serves to dissolve a solute when mixed to form a solution. As used herein, "solution" may refer to a mixture of a solute dissolved in a solvent, such as an API dissolved in filtered water, an excipient dissolved in filtered water, an additive and an API dissolved in a mixture of an excipient and filtered water, or other resultant mixture of components.

Four exemplary variants 10A, 10B, 10C, 10D of an example method or process of mixing a pharmaceutical solution (i.e., mixing a solute in a solvent) in a flexible mix bag according to the teachings of the present disclosure are illustrated in FIGS. 1A, 1B, 1C, and 1D. The four method variants 10A, 10B, 10C, and 10D differ in the order of performing the method steps. The order may vary according to the architecture and layout of a particular mixing system as well as the solute properties (e.g., whether the solute is a powder or liquid). In a first method variant 10A of FIG. 1A, a first step 14 is adding a gas, such as, for example, filtered ambient air or an inert gas such as Nitrogen, into an empty, interior compartment of a mix bag. The mix bag, also referred herein as a single-use container, includes a wall defining the interior compartment having a top portion and a bottom portion. Filling the bag with gas facilitates assembly of mounting the mix bag to a mix tank. Further, the method 10A includes a step 18 of adding a solvent into the interior compartment, also referred herein as an "interior chamber" of the mix bag. In this example, the solvent may be purified or filtered water from a reverse osmosis ("RO") system, such as a Milli-Q CLX 7000 series or a Millipore AFS 40E, 80E, 120E, or 150E series, and the solvent is added to the bag through a sealable port disposed in either the top portion or the bottom portion of the mix bag. Adding the solvent 18 into the mix bag may include pumping a solvent by a pump into the mix bag, and then discontinuing the pump when a predetermined level or weight of solvent has been reached. For example, a load cell or scale disposed near or adjacent to the bottom portion of the mix bag detects when a certain volume of solvent has been added to the mix bag. The load cell or scale may directly or wirelessly communicate to the pump coupled to the solvent source to stop pumping.

The wall of the mix bag and a top surface level of the solvent define a headspace, which contains the gas added to the mix bag from the previous step 14. While the illustrated method 10A includes the step 14 of adding a gas to the mix bag prior to the step 18 of adding a solvent to the mix bag, in a second method variant 10B of FIG. 1B, the order of these steps are reversed such that the step 18 of adding the solvent is performed before the step 14 of adding a gas to the mix bag.

The methods 10A and 10B further include establishing a bubble to mix the components within the mix bag. The step 22 of establishing a bubble column in the interior compartment of the mix bag includes activating a recirculation assembly. The recirculation assembly is closed to maintain sterility and is configured to draw gas from the headspace and deliver the drawn gas to the interior chamber of the mix bag at the bottom portion of the mix bag. The recirculation assembly includes a connecting line and a pump, such as a peristaltic pump, operably coupled to the connecting line. The connecting line is coupled (e.g., attached, connected, fixed) to a top port and a bottom port of the mix bag. Using a small gas headspace above the liquid in the single use container as a gas supply, the peristaltic pump affecting a line of the sealed system can draw gas from the top and pump it through the bottom creating the bubble column from a self-renewing source. In some examples, the recirculation assembly may include an additional pump and connection line connected to the headspace and the bottom portion of the mix bag at separate ports. This additional circulation line and pump may be utilized when a stronger bubble column is required for mixing or to speed up the mixing process.

Once a bubble column is established, the first and second method variants 10A and 10B include a step 26 of adding a solute to the interior chamber of the mix bag. The solute, which may be, for example, an active pharmaceutical ingredient ("API") in powder form or a liquid excipient, may be dispensed into the top portion of the interior chamber, and specifically into the headspace, of the mix bag through a top port. Even more specifically, the solute may be added to the mix bag through a port that is aligned with the bottom port in which a bubble column is formed. In some examples, adding a solute may first include adding an excipient to the solvent and then adding an API to the mix bag. Both excipient and API may be in powder or liquid form.

The added components, which may include a solvent, a solute, and/or an excipient, are mixed until the mixture is homogenous. The mixture may be homogenous when a difference between an assayed concentration reading of a mix bag top sample and an assayed concentration reading of a mix bag bottom sample of the mixture is approximately 2% or less. In another example, the mixture may be sampled to check for concentration, pH, or other solution properties via a port in the side of the mix bag adjacent to the bottom portion of the mix bag. To correct pH, for example, a pH adjusting agent may be injected into the mix bag via a luer lock syringe. Alternatively, a time for mixing may be determined so that the recirculation pump of the recirculation assembly stops after the predetermined time has been reached. The recirculation assembly may be deactivated and the solution may be drained from a bottom port of the mix bag for further processing and/or distribution. Further processing steps may include, for example, adjusting the pH of the solution, filtering for sterilization, and distribution into product bags.

The exemplary methods 10A, 10B, 10C, 10D involve additional steps that may be incorporated in various mixing systems according to the specific architecture or layout of each mixing system. Thus, the following descriptions of the various mixing system configurations of FIGS. 2-9C further elaborate on the method variants 10A, 10B, 10C, 10D of FIGS. 1A-1D.

Figure 2:
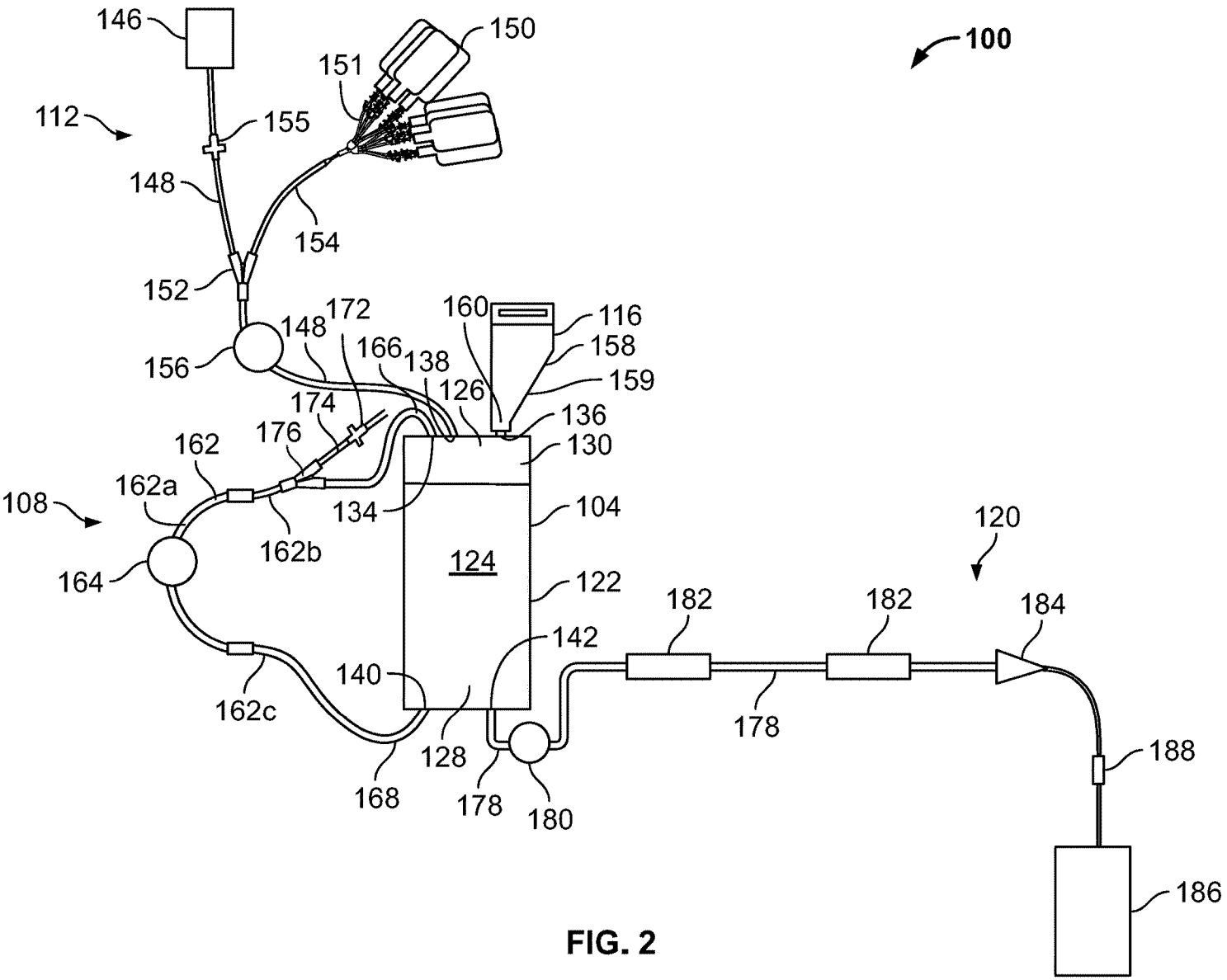
FIG. 2 is a schematic diagram of a mixing system for mixing a pharmaceutical solution according to the teachings of a first exemplary arrangement of the present disclosure.
Figure 3B:
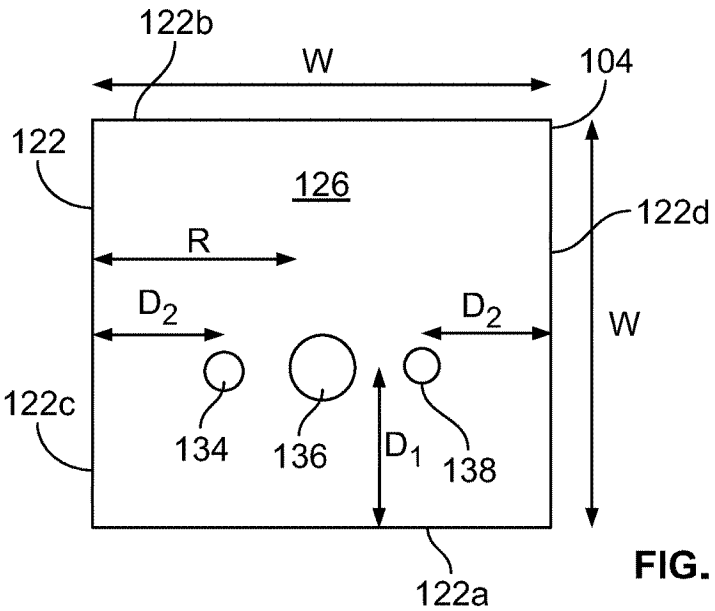
FIG. 3B is a top view of the mix bag of FIG. 3A.
Figure 3C:
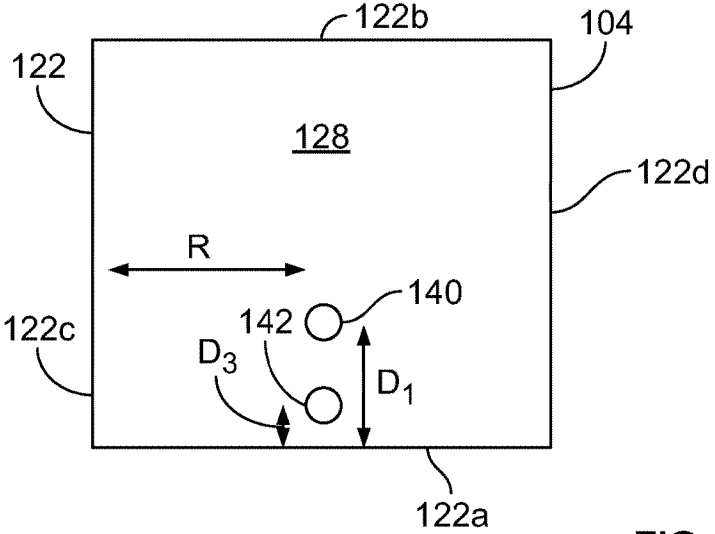
FIG. 3C is a bottom view of the mix bag of FIG. 3A.
Figure 3A:
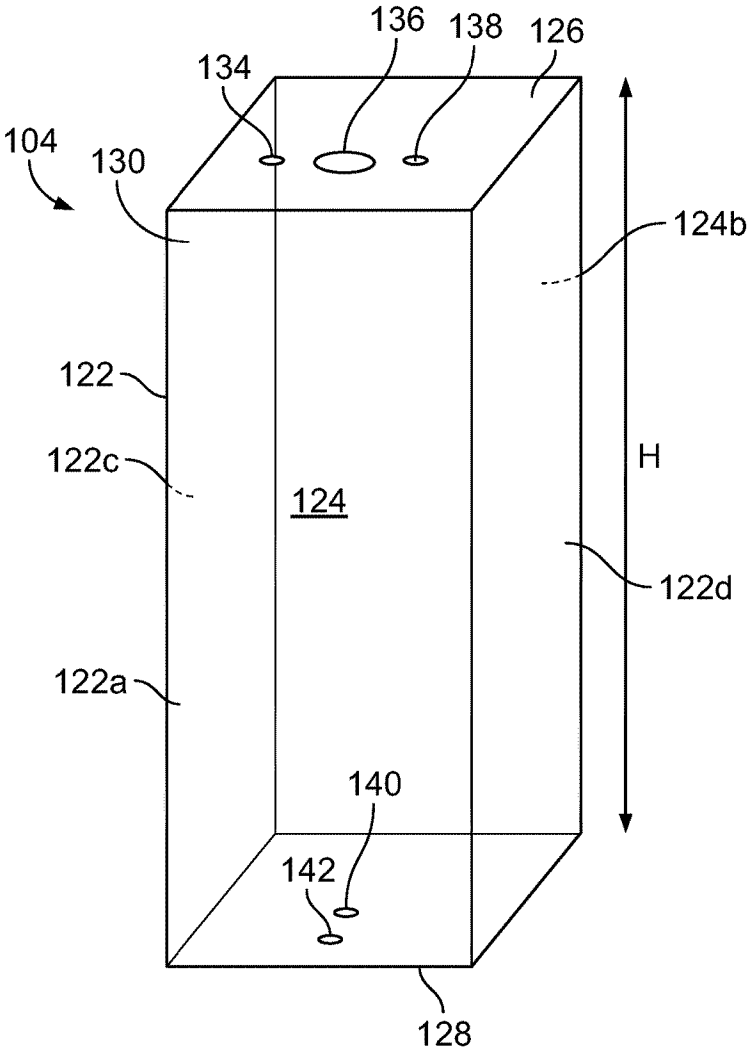
FIG. 3A is a perspective view of a mix bag of the mixing system of FIG. 2 according to the teachings of a first exemplary mix bag arrangement of the present disclosure.

A first exemplary bubble agitation system 100 of FIG. 2 is constructed according to the teachings of the present disclosure, and is configured to perform at least one of the methods 10A-10D of FIGS. 1A-1D. The agitation system 100, also referred herein as a "mixing system" and a "bubble mixing system," includes a mix bag 104 operably coupled to a recirculation assembly 108, a solvent assembly 112, a solute assembly 116, and a downstream assembly 120. The mix bag 104 in FIGS. 3A-3C is a disposable (i.e., single-use) and flexible walled enclosure, and includes a bag wall 122 defining an interior chamber 124, a top portion 126, and a bottom portion 128 opposite the top portion 126. In the illustrated example, the mix bag 104 is cubic, and therefore includes a front wall 122*a*, a back wall 122*b*, and first and second side walls 122*c*, 122*d*. The walls 122*a*-122*d*, top portion 126, and bottom portion 128 of the mix bag 104 define an interior chamber 124 having a clean or sterile environment. As used herein, "top portion" 126 may refer to a top wall of the cubic mix bag, and "bottom portion" 128 may refer to a bottom wall of the cubic mix bag. The terms "top portion" and "bottom portion," as used herein, may also refer to general areas or parts of the interior chamber 124 of the mix bag 104. While the illustrated mix bag 104 includes one, undivided interior chamber 124, other example mix bags may include two or more chambers separated by an interior wall or seal. In these examples, the seal or dividing wall between the chambers may be configured to rupture to fluidly connect the divided chambers.

The interior chamber 124 includes a headspace 130 disposed adjacent to the top portion 126 of the mix bag 104 and contains a gas when gas is added to the mix bag 104, such as in step 14 of the method 10A of FIG. 1A, for example. Turning back to FIGS. 2-3C, the mix bag 104 includes at least one top port extending through the wall 122 of the top portion 126 of the mix bag 104, and at least one bottom port extending through the wall 122 of the bottom portion 128 of the mix bag 104. In particular, the mix bag 104 includes a first top port 134, a second top port 136, and a third top port 138 that extend through the wall 122 of the top portion 126 to fluidly couple to the interior chamber 124 of the mix bag 104. As used herein, "fluidly coupled" refers to providing or permitting fluid and/or communication. In a cubic mix bag 104, such as the mix bag 104 shown in FIGS. 3A-3C, the top ports 134, 136, 138 are disposed through a top wall. The mix bag 104 also includes a first bottom port 140 (i.e., a bottom gas circulation port) and a second bottom port 142 that extend through the wall 122 of the bottom portion 128 of the mix bag 104 to fluidly couple to the interior chamber 124 of the mix bag 104. The bottom ports 140, 142 are disposed through a bottom wall of the cubic mix bag 104. In other examples, the top ports 134, 136, 138 may be disposed through walls 122*a*-122*d* adjacent to the top portion 126 of the mix bag 104, and the bottom ports 140, 142 may be disposed through walls 122*a*-122*d* adjacent the bottom portion 128 of the mix bag 104. To ensure that the mixing system 100 remains closed, each of the ports 134, 136, 138, 140, 142 may be a hose barb port and each port covered by a cap. One or more of the ports 134, 136, 138, 140, 142 may have a T configuration, or may be a valve, such as a Horen® aseptic RoPlug Valve, to control flow through the one or more ports 134, 136, 138, 140, 142.

FIGS. 3A-3C illustrate a specific mix bag configuration. In one example of the mix bag 104, each of the first and third top ports 134 and 138 and the first and second bottom ports 140 and 142 has an inner diameter in a range of approximately 0.2 inches and 0.3 inches, and preferably 0.25 inches, and the second port 136 has an inner diameter of 2.0 inches. The 2.0 inch inner diameter of the second port 136 is particularly suited to connect with a powder excipient container or API container, and the 0.25 inch inner diameter of the other ports 134, 138, 140, 142 are particularly suited to couple (e.g., snap fit, interference fit, threadably connect, rotatably lock) to flexible tubing used in the mixing system 100. The mix bag 104 has a height H of 47 inches, and a width W of 23.5 inches. The second top port 136 and the first bottom port 140 are disposed a distance R of 11.75 inches inward from the side wall 122*c* of the bag 104 and a distance D1 of 7.0 inches inward from the front wall 122*a* of the mix bag 104, therefore the second top port 136 and the first bottom port 140 are axially aligned. The first and third top ports 134 and 138 are each a distance D2 of 9.75 inches inward from the side wall 122*c* of the mix bag 104, and the second bottom port 142 is 2.0 inches inward from the front wall 122*a* of the mix bag 104. The mix bag 104 of FIGS. 3A-3C is just one example of a mix bag 104 used in the system 100 of FIG. 2, and many other variations of mix bag wall dimensions or of port arrangements, including number of ports and location of each port relative to each other and to the walls 122*a*-122*d*, are possible. This particular bag configuration may be used when a water line (i.e., solvent 146) separately connects to a container 150 containing an excipient upstream the mix bag 104. However, in other configurations, the top portion 126 of the bag 104 may have one or more additional ports to connect a powder or liquid solute or to recirculate gas to the interior chamber 124 of the mix bag 104. For example, the mix bag 104 may have two powder receiving ports, one water or solvent port, two top gas recirculation ports, and two bottom gas recirculation ports. The bottom portion 128 of the bag 104 may a third port on the sidewall adjacent to the bottom wall to drain or sample the contents of the mix bag 104 or to introduce/inject an additive via a luer lock syringe.

Turning back to the system 100 of FIG. 2, the solvent assembly 112 includes a solvent 146 coupled to a solvent line 148. The solvent line 148 is fluidly coupled to the interior chamber 124 of the mix bag 104 to deliver the solvent 146 through the third top port 138. However, in other examples, the solvent line 148 may be coupled to a bottom port. The solvent assembly 112 is coupled (e.g., removably connected, joined, fixed, attached) to the container containing the excipient 150 at a Y-connector 152 disposed in the solvent line 148. The excipient container 150 includes a plurality of product bags containing a liquid excipient and is fluidly coupled to an excipient line 154 via a spiked manifold assembly 151. The excipient line 154 connects with the solvent line 148 at the Y-connector 152. A solvent pump 156, which may be a peristaltic pump, is operably coupled to the solvent assembly 112 at a position downstream from the Y-connector 152 of the solvent line 148, and is configured to pump the solvent 146 and the excipient into the interior chamber 124 of the mix bag 104 via the third top port 138. In other words, the third top port 138 is a solvent port 138. However, in another example, the pump 156 may be positioned upstream from the Y-connector 152 and coupled to either the solvent line 148 or the excipient line 154. In the illustrated system 100, the solvent 146 may be filtered through a filter 155 that is disposed in-line with the solvent line 148 and upstream from the Y-connector 152. However, in other examples, the source of solvent 146 may already pre-filter or pre-sterilize the solvent. In some examples, the solvent 146 may be water that mixes with the excipient before the method 10A-10D performs the step 18 of adding the solvent 146 to the mix bag 104. In this case, the step 18 of adding solvent 146 of the method 10A-10D includes adding both the solvent 146 and the excipient into the interior chamber 124 of the mix bag 104 before establishing the bubble column 112. In another example, the solvent 146 may not be mixed with the excipient at this stage of the method 10. For example, the container 150 containing the excipient may be directly coupled to the mix bag 104 at a separate top port and dispensed into the interior chamber 124 of the mix bag 104 after the water solvent 146 has been added to the bag 104. As used herein, "line" may refer to a pathway, such as a tube, conduit, chute, channel, and may be flexible or rigid.

In the illustrated example, a solute of the solute assembly 116 is a powdered API, such as Vancomycin powder, and is disposed within a container 158, such as a product bag, specifically designed to funnel powder API through the connecting port 136. The container 158 provides a slip angle 159 to facilitate flow of the API out of the container 158 and into the interior chamber 124 of the mix bag 104 via the second top port 136. The second top port 136 is specifically a solute discharge port with an inner diameter that is large enough to sealably couple (e.g., connect, attach, fix) to a solute line 160 to facilitate delivery of the powder solute into the interior chamber 124 of the mix bag 104. The solute line 160 may be integrally formed with the solute container 158 and is configured to deliver the solute gradually or at predefined rate. The solute line 160 is sealed to preserve hermetic integrity. For example, the solute line 160 may be closed by a clamp configured to open and close the line 160 to release the solute without compromising the sterility of the mix bag 104 or of the solute. In a system that does not include an excipient coupled to the solvent assembly 112, the solute may instead be a powder excipient, such as Dextrose, and the solute line 160 may be a connecting line that fluidly couples the solute assembly 116 with the solute port 136 of the mix bag 104. The disclosed system 100 evenly distributes a solute, which may be in powder or liquid form, in a solvent-filled, single-use mix bag. In some cases, when dispensing a powder solute into the interior chamber 124 of the mix bag 104, the powder may adhere to an interior surface of the walls 122 of the mix bag 104. In this case, the method step 26 of adding a solute into the mix bag may include spraying down the interior surface of the walls 122 of the mix bag 104 with solvent 146 using the flexible solvent line 148 and port 138.

The recirculation assembly 108 includes a connecting line 162 (also referred herein as a "connecting pathway") and a recirculation pump 164 operably coupled to the connecting line 162. The connecting line 162 has a first end 166 coupled to the first top port 134 (i.e., a top gas circulation port) and a second end 168 coupled to the first bottom port 140 (i.e., the bottom gas circulation port) of the mix bag 104. In other words, the first top port 134 is a top gas recirculation port 134, and the first bottom port 140 is a bottom gas recirculation port 140. Thus, the first end 166 of the connecting line 162 is coupled to the top gas recirculation port 134 and the second end 168 of the connecting line 162 is coupled to the bottom gas recirculation port 140. The recirculation pump 164 is operative to pull the gas contained in the headspace 130 of the mix bag 104 and deliver the gas through the connecting line 162 and into the interior chamber 124 of the mix bag 104 via the bottom gas recirculation port 140. The connecting line 162 and the bottom gas recirculation port 140 are configured to discharge the gas drawn from the headspace 130 into the interior chamber 124 of the bottom portion 128 of the mix bag 104 to form a bubble column. The solute and the solvent 146 are mixed by bubble agitation from the bubble column and turbulence created in the interior chamber 124 of the mix bag 104 until a homogenous pharmaceutical solution is formed. The recirculation pump 164 may be a peristaltic pump or another suitable pumping mechanism that does not compromise the sterility of the closed mixing system 100. A peristaltic pump maintains the hermetic integrity or sterility of the recirculation assembly 108, and therefore the system 100, by compressing the connecting line 162 to push fluid through the line 162. In another example, a pump that may not be a peristaltic pump may be used given that the pump does not contaminate the internal sterility of the system 100. Where the solute requires greater mixing rate, for example Dextrose in powder form, the mix bag 104 will have an additional top gas recirculation port, bottom gas recirculation port, connection line, and pump to create a larger bubble column.

Method step 14 of the method 10A-10D of FIGS. 1A-1D includes adding a gas into the interior compartment 124. In one example, the recirculation assembly 108 is operated to provide filtered ambient air into the interior compartment 124 by drawing ambient air through an air filter 172 that is coupled to the connecting line 162. The filtered ambient air is pumped into the interior compartment 124 of the mix bag 104 by the pump 164. The connecting line 162 is coupled to an auxiliary air line 174 at a second Y-connector 176 and the auxiliary air line 174 is coupled to the air filter 172. While the mix bag 104 is being filled with gas, the first end 166 of the connecting line 162 is clamped off from the gas. Prior to activating the recirculation assembly 108 to establish a bubble column of step 22, ambient air from the surrounding environment is pulled through the auxiliary air line 174 and filter 172, and then pumped into the bottom portion 128 to form the headspace 130 of the of the mix bag 104. The port 134 and the first end 166 of the connecting line 162 are closed off during this method step 14. However, in some examples, the auxiliary air line 174 is pumped into the top portion 126 of the mix bag 104 via the first end 166 of the connecting line 162 when the pump 164 is reversed. In another example, the method step 14 of adding gas to the interior compartment of method 10A-10D may include adding a gas, such as Nitrogen gas, to the mix bag 104 without requiring a filter 172 or even a pump. In this example, the connecting line 162 may be attached to a gas tank, such as a Nitrogen gas tank to fill the interior compartment 124 with a desired amount of gas.

As discussed previously, the step 14 of adding gas to the mix bag 104 may be performed after the solvent 146 (e.g., the solvent 146 alone or with the excipient) is added to the mix bag 104 (e.g., methods 10A, 10D). The air filter 172, connecting line 162, and auxiliary air line 174 are configured to filter air before filling the mix bag 104 with gas to form the headspace 130. After the headspace 130 is filled with gas (i.e., filtered ambient air), the air filter 172 and auxiliary air line 174 may be removed from the connecting line 162, heat sealed, clamped by a hemostat, or otherwise closed off to maintain a closed system. The first end 166 of the connecting line 162 is open to permit recirculation through the top port 134. In another example, the headspace 130 may be filled with an inert gas, such as Nitrogen, instead of filtered ambient air.

The drain assembly 120 of the system 100 of FIG. 2 is configured to drain the mixed pharmaceutical solution from the mix bag 104 for further processing and/or final packaging. The drain assembly 120 includes a drain line 178 coupled to the second bottom port 142, a drain pump 180, one or more filters 182, and a nozzle 184. The one or more filters 182 may be a Pall Supor® sterilizing grade filter. The drain assembly 120 may be any suitable downstream process that further sterilizes the solution to meet certain sterility standards depending on the pharmaceutical solution formed. The drain assembly 120 may be separable from the other components of the system 100 such that the method 10A-10D of mixing is separate from further processing. Once the solution is passed through one or more stages of sterilization, a plurality of containers, such as a product bag 186 in FIG. 2, may be coupled to the nozzle 184 and the solution may be dispensed into the product bag 186. If further sterility is required, a filter 188 may be coupled to the product bag 186 to filter the solution before the solution enters the product bag 186. The filter 188 is a membrane filtration device and in one version can include the membrane filter disclosed in U.S. Pub. No. 2012/0074064 and PCT/EP2015/068004, which are incorporated herein by reference. While the schematic diagram of the system 100 of FIG. 2 illustrates the nozzle 184 coupled to one product bag 186, the nozzle 184 may be configured to simultaneously fill a plurality of product bags 186. Additionally, the drain assembly 120 may include more or fewer components, and may be disconnected from the drain line 178. The one or more filters 182 may be a fibrous material designed and rated to be a sterilizing grade filter. For example, the fibrous material may be produced with a porosity of 0.2 microns (μm). Other methods or devices readily available to a skilled person in the art may be used to further process the solution and dispense the solution into individual product bags 186. These product bags 186, various components and characteristics thereof, and other examples that could be used in the disclosed drain assembly 120 are disclosed in PCT Application No. PCT/US17/14253, entitled "STERILE SOLUTIONS PRODUCT BAG," filed Jan. 20, 2017, and European Patent Application No. EP16152332.9, entitled "FILTER MEMBRANE AND DEVICE," filed Jan. 22, 2016, the entirety of each being expressly incorporated herein by reference. As previously mentioned, the bottom port 142 may be disposed in a sidewall 122 of the mix bag 104 and is configured to draw samples of the solution for testing, adjust the solution by introducing additives, and to connect to a downstream filter train and filling system.

The connecting line 162, the solvent line 148, the excipient line 154, the solute line 160, the auxiliary air line 174, and the drain line 178 of the first exemplary mixing system 100 may be sterile, high-pressure, polyurethane tubes, such as, for example Thyroxine Binding Globulin ("TBG") tubes. Each of the connecting line 162, solvent line 148, excipient line 154, solute line 160, auxiliary air line 174, and drain line 178 is compatible with a peristaltic pump, such as the recirculation pump 164 and the solvent pump 156. Each line 148, 154, 160, 162, 174, 178 may be one continuous tube, or each line may be composed of a plurality of tubes coupled by one or more hose barbs. For example, the connecting line 162 of the recirculation assembly 108 includes a portion 162*a* that is compressed by the recirculation pump 164 (when the recirculation assembly 108 is activated) and first and second portions 162*b*, 162*c* corresponding to the first and second ends 166, 168 of the connecting line 162. The portion 162*a* engaged by the pump 164 includes an inner diameter (e.g., 0.5 inches) that is greater than an inner diameter (e.g., 0.25 inches) of the other portions 162*b*, 162*c* of the connecting line 162. As used herein, when one of these lines 148, 154, 160, 162, 174, 178 is coupled or connected to a port 134, 136, 138, 140, 142 of the mix bag 104, the line 148, 154, 160, 162, 174, 178 may be directly coupled or indirectly coupled to the port 134, 136, 138, 140, 142 such that a fluid connection can be made between inlet and outlet ends of each line 148, 154, 160, 162, 174, 178. Each line 148, 154, 160, 162, 174, 178 may be fluidly coupled (e.g., in fluid and/or flow communication) with the interior chamber 124 of the mix bag 104 when the line 148, 154, 160, 162, 174, 178 is coupled to one of the ports 134, 136, 138, 140, 142. In some cases, the ports 134, 136, 138, 140, 142 may be regulated to control fluid communication, for example, with a valve. The lines 148, 154, 160, 162, 174, 178 may be the same type of flexible tube, or the lines 148, 154, 160, 162, 174, 178 may be different. For example, the solute line 160 may be a different type of pathway, such as a chute or a valve.

Figure 4:
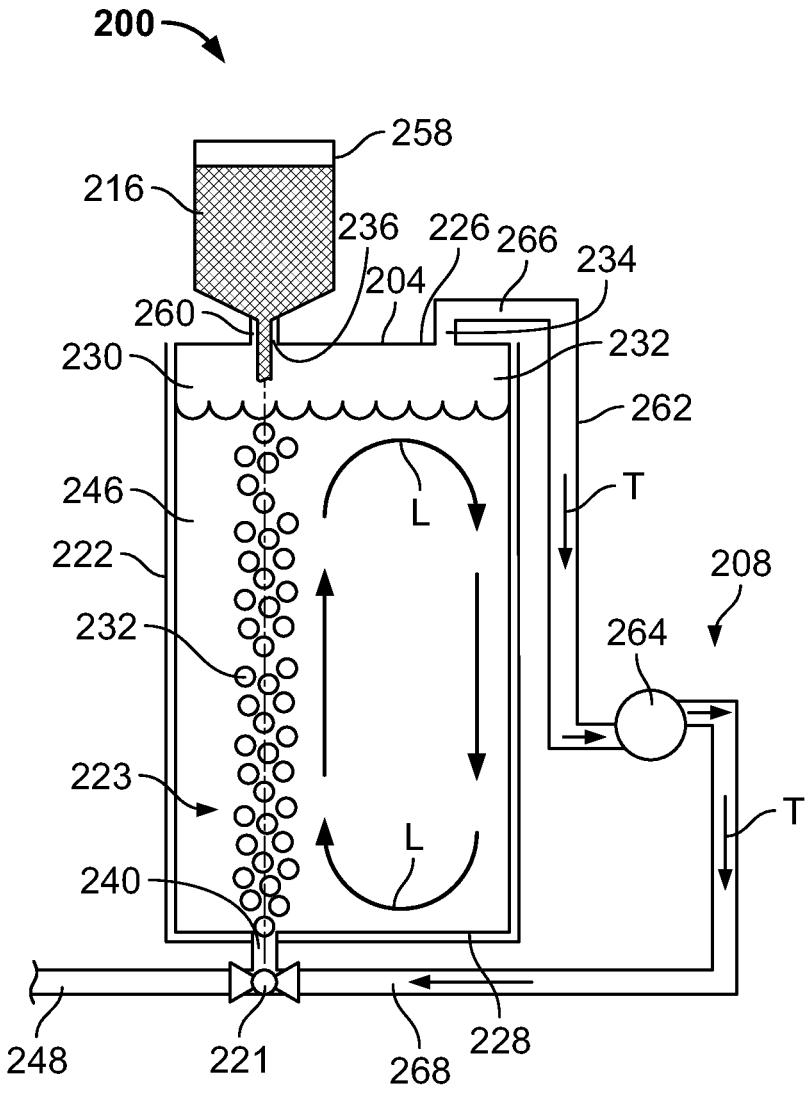
FIG. 4 is a schematic diagram of a mixing system for mixing a pharmaceutical solution according to the teachings of a second exemplary arrangement of the present disclosure.

FIG. 4 illustrates a second exemplary system 200 constructed in accordance with the teachings of the present disclosure. The second system 200 performs at least one of the methods 10A-10D of FIGS. 1A-1D, and is similar to the system 100 of FIG. 2. The system 200 includes a second exemplary mix bag 204, a recirculation assembly 208, a solute assembly 216, and a solvent 246. Thus, for ease of reference, and to the extent possible, the same or similar components of the system 200 will retain the same reference numbers as outlined above with respect to the first system 100, although the reference numbers will be increased by 100. However, the second system 200 differs from the first system 100 in the manner discussed below.

By comparison to the system 100 of FIG. 2, the mix bag 204 of the system 200 includes a first top port 234 (i.e., a top gas recirculation port) and a second top port 236 and one bottom port 240 (i.e., a bottom gas circulation port). In this arrangement, the method step 18 of filling the mix bag 204 with a solvent 246 includes pumping the solvent 246 through the bottom port 240 of the mix bag 204. A solvent assembly, while not fully illustrated in FIG. 4, may be similar to or the same as the solvent assembly 112 of the system 100 of FIG. 2 except that a solvent line 248 of the second system 200 is coupled to the bottom port 240. A recirculation assembly 208 of FIG. 4 is fluidly coupled to a headspace 230 filled with a gas 232 and coupled to the bottom port 240 of the mix bag 204. While not illustrated, the connecting line 262 may be connected to an auxiliary air line or ambient air line to fill the mix bag 204 with gas.

The mix bag 204 has fewer ports than the first exemplary mix bag 104, and incorporates a valve 221, such as a three-way rotary valve, that is operably coupled to the bottom port 240 to perform the step 18 of adding solvent 246 to the mix bag 204, the step 22 of establishing a bubble column 223, and also a step of draining the mix bag 204 of a solution 233 after mixing is complete. The valve 221 is operably coupled to the bottom port 240 to control fluid flow (e.g., gas or liquid) through the bottom port 240 and into, or out of, an interior chamber 224 of the bag 204. The valve 221 is coupled to the solvent line 248 at a first intake of the valve 221 and coupled to a connecting line 262 of the recirculation assembly 208 at a second intake of the valve 221. The valve 221 is operable to partially close in at least two open positions or states. In a first open position, the valve 221 fluidly couples (i.e., permits fluid communication between) the bottom port 240 to the solvent line 248, thereby closing the connecting line 262 off from the bottom port 240 and the solvent line 248. In a second open position, the valve 221 fluidly couples the bottom port 240 to the connecting line 262, thereby closing the solvent line 248 from the bottom port 240. The valve 221 may be completely closed, as well.

Figure 5B:
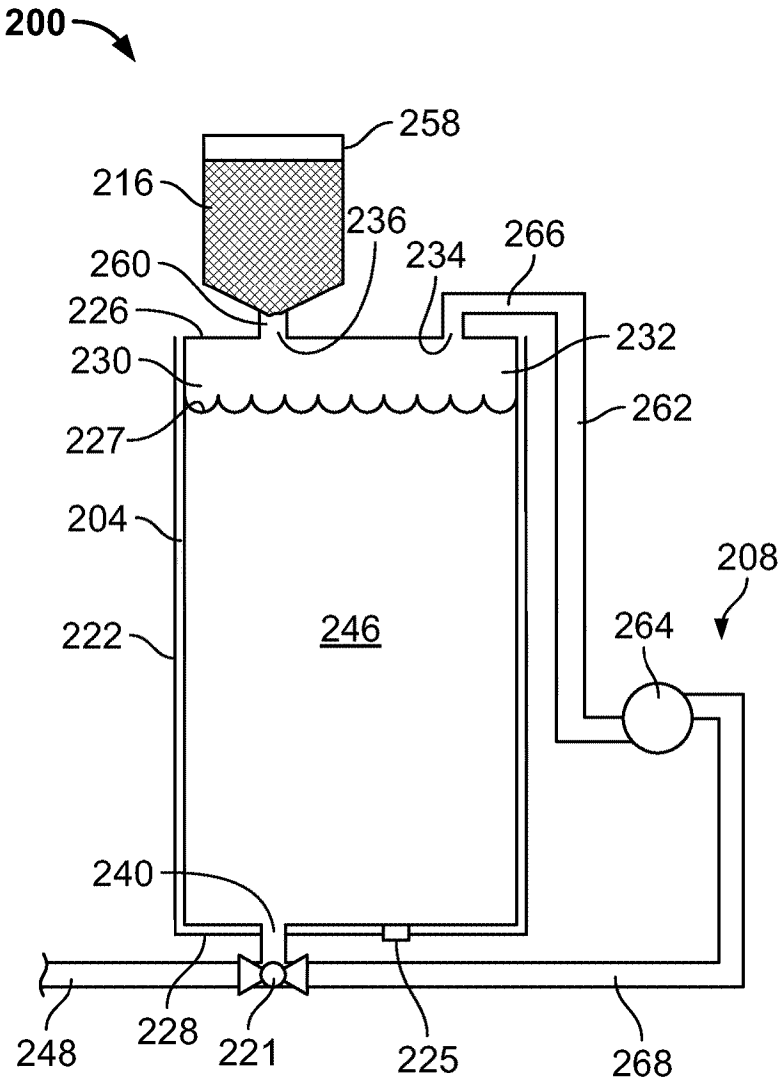
FIG. 5B illustrates the mixing system of FIG. 4 after the solvent is added to the mix bag.
Figure 5A:
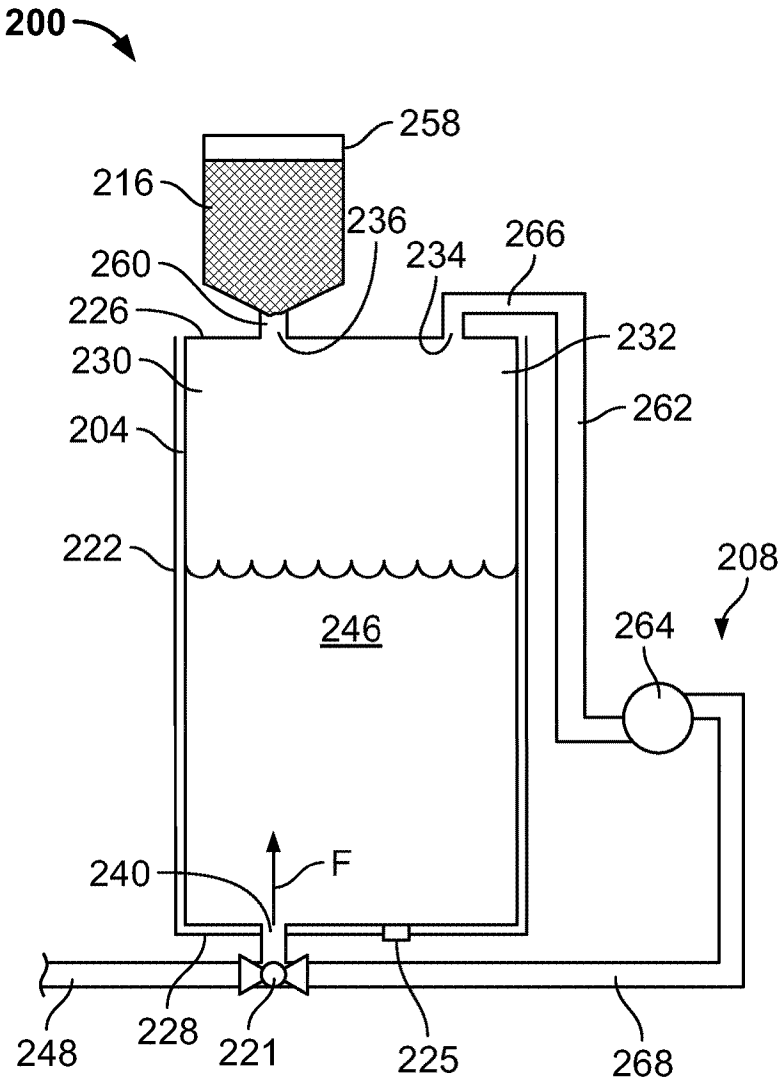
FIG. 5A illustrates the mixing system of FIG. 4 with a valve coupled to a bottom port of a second exemplary mix bag arrangement, the mix bag being filled with a solvent.

FIGS. 5A-5F illustrate how the second exemplary system 200 of FIG. 4 performs at least one of the methods 10A-10D of FIGS. 1A-1D. In FIG. 5A, the step 18 of adding a solvent 246 to the mix bag 204 is shown, and is pumped through the bottom gas circulation port 240 of the mix bag 204 to a predetermined amount. The valve 221 is in an open position such that a solvent 246 flows in a direction F through the first intake of the valve 221 and into a bottom portion 228 of the mix bag 204 via the bottom port 240. The mix bag 204 may be placed on a load cell 225 to measure the contents of the mix bag 204. When a predetermined value is measured by the load cell 225, a desired amount of solvent 246 has been added to the mix bag 204, which may trigger an alert, send a signal, or communicate with an operator to discontinue filling the mix bag 204 with solvent 246. At this point, and as shown in FIG. 5B, the first intake of the valve 221 is closed to prevent fluid flow between the solvent line 248 and the interior chamber 224 of the mix bag 204 via the bottom port 240. If a pump was used to deliver solvent 246 to the mix bag 204, the pump may be turned off or disconnected from the system 200. A headspace 230 is defined by the wall 222 of the mix bag 204 and an upper surface layer 227 of the solvent 246.

Figure 5D:
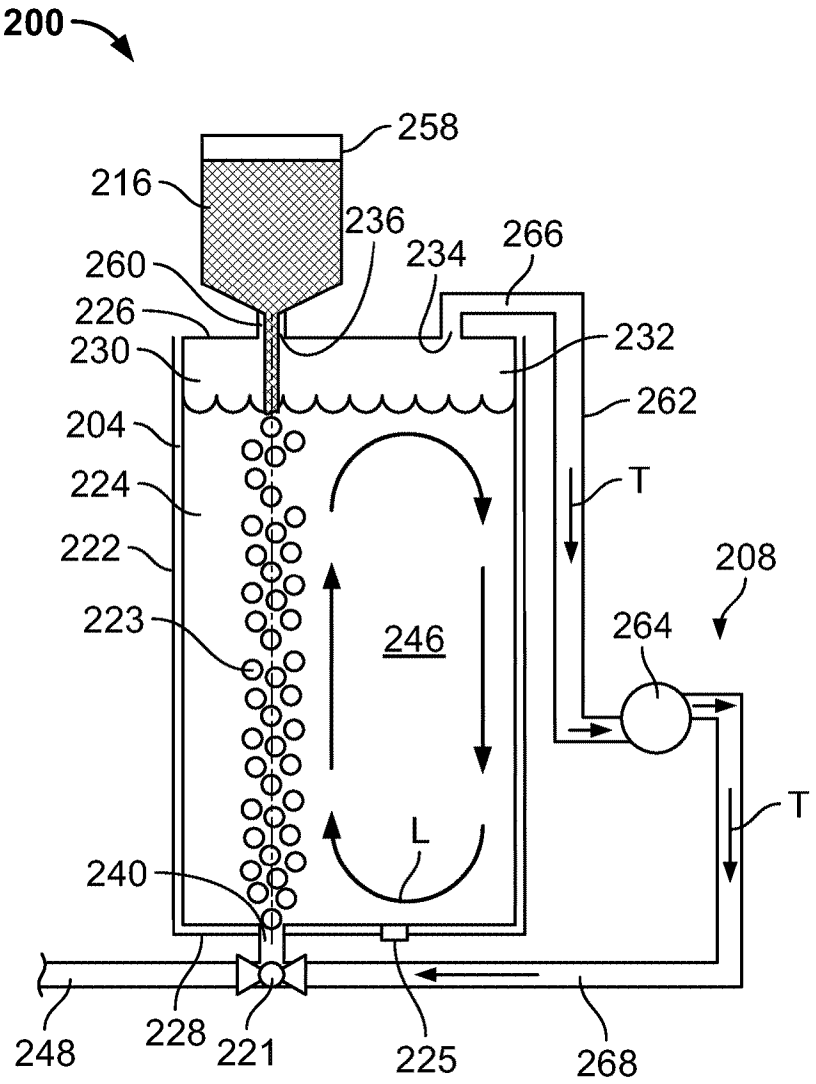
FIG. 5D illustrates the mixing system of FIG. 4 with a solute being added to the mix bag.
Figure 5C:
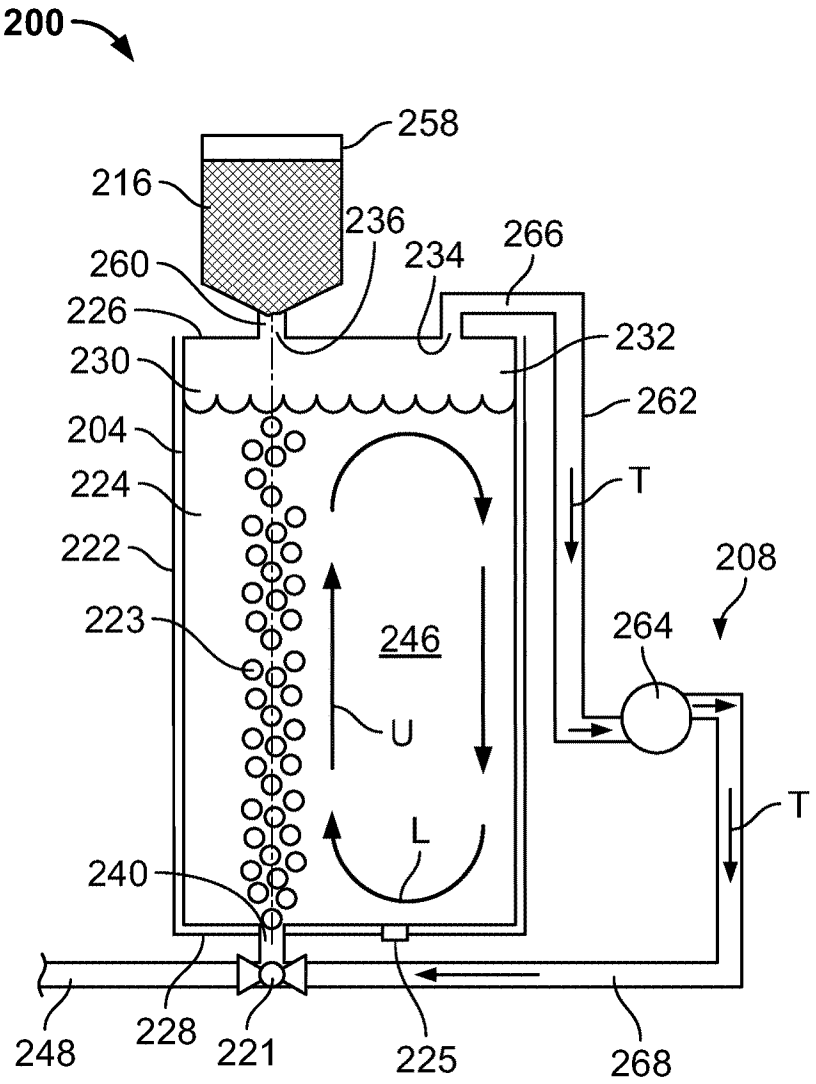
FIG. 5C illustrates the mixing system of FIG. 4 when a pump is activated to establish a bubble column within the mix bag.

In FIG. 5C, the step 22 of establishing a bubble column 223 is shown. To establish the bubble column 223, the valve 221 is opened to fluidly couple the connecting line 262 with the interior chamber 224 of the mix bag 204 via the bottom port 240, and a recirculation pump 264 of the recirculation assembly 208 is turned on to pump fluid (e.g., gas 232 from headspace 230) in a direction T. The recirculation pump 264 is configured to continuously draw gas 232 from the small gas headspace 230 of the mix bag 204 through the top gas recirculation port 234 and pump the gas 232 through the bottom port 240 while the recirculation assembly 208 is activated. Specifically, the pump 264 is a peristaltic pump and therefore engages with an exterior casing of the connecting line 262 to move the gas 232 in the direction T through the connecting line 262 and into the interior chamber 224 of the mix bag 204. A second end 268 of the connecting line 262, which is coupled to the bottom port 240 via the valve 221, is configured to deliver the recirculated gas 232 into the interior chamber 224 at the bottom portion 228 of the mix bag 204 to form the bubble column 223. The bubble column 223 forms when the recirculated gas 232 is discharged into the solvent 246 contained in the interior chamber 224 and rises upward in a direction U in the form of gas bubbles toward the headspace 230. With the nature of fluid viscosity, liquid solvent 246 is entrained upward in the direction U from the bottom portion 228 of the mix bag 204 with the rising bubble column 223. Thus, the liquid solvent 246 within the interior chamber 224 of the mix bag 204 creates a fluid turn over L in the mix bag 204. The gas 232 from the bubble column 223 is released into the headspace 230 before being drawn again into the top gas recirculation port 234 and circulated by the recirculation assembly 208. Thus, the system 200 advantageously uses a self-renewing gas source (i.e., gas 232 contained in the headspace 230) to establish the bubble column 223 for mixing.

The solute assembly 216 is coupled to a solute port 236 in the top portion 226 of the mix bag 204. After the bubble column 223 is established in the mix bag 204, the method step 26 of adding a solute of the solute assembly 216 includes dispensing the solute, which is initially contained in a container 258, through a solute line 260 and into the headspace 230 of the mix bag 204. A solute bag 258 is pre-assembled and connected to the mix bag 204 to avoid exposing the interior chamber 224 to the environment after the method of mixing has commenced. The solute assembly 216 may be clamped such that the solute is not dispensed into the interior chamber 224 until a clamp is released at method step 26. As shown in FIG. 5D, the solute is discharged substantially above the bubble column 223 for optimal mixing. In some examples, the solute port 236 is in substantial axial alignment with the bottom gas recirculation port 240 such that at least a majority of the solute introduced through the solute port 236 is within the bounds of the bubble column 223. The continuous bubble column 223 may entrain and distribute the solute in the rising bubble column 223 and turn over a mixture of solute and solvent 246 within the mix bag 204 to create a homogenous solution. When a solute that is heavier than the solvent 246 is added directly above the bubble column 223, the solute may be slowed in its descent and agitated in the bubble column 223, thereby creating a higher mixing energy in the bubble column 223 beyond the turn over mixing L. The solute may be an API powder, as described previously with respect to the first system 100 of FIG. 2, or the solute may be a liquid excipient, such as Dextrose. The recirculation pump 264 continues in the direction T to circulate gas from the headspace 230 into the bottom portion 228 of the mix bag 204 to mix the solute and the solvent 246 until the contents are thoroughly mixed to form a homogenous solution 233, which is shown in FIG. 5E.

Figure 5F:
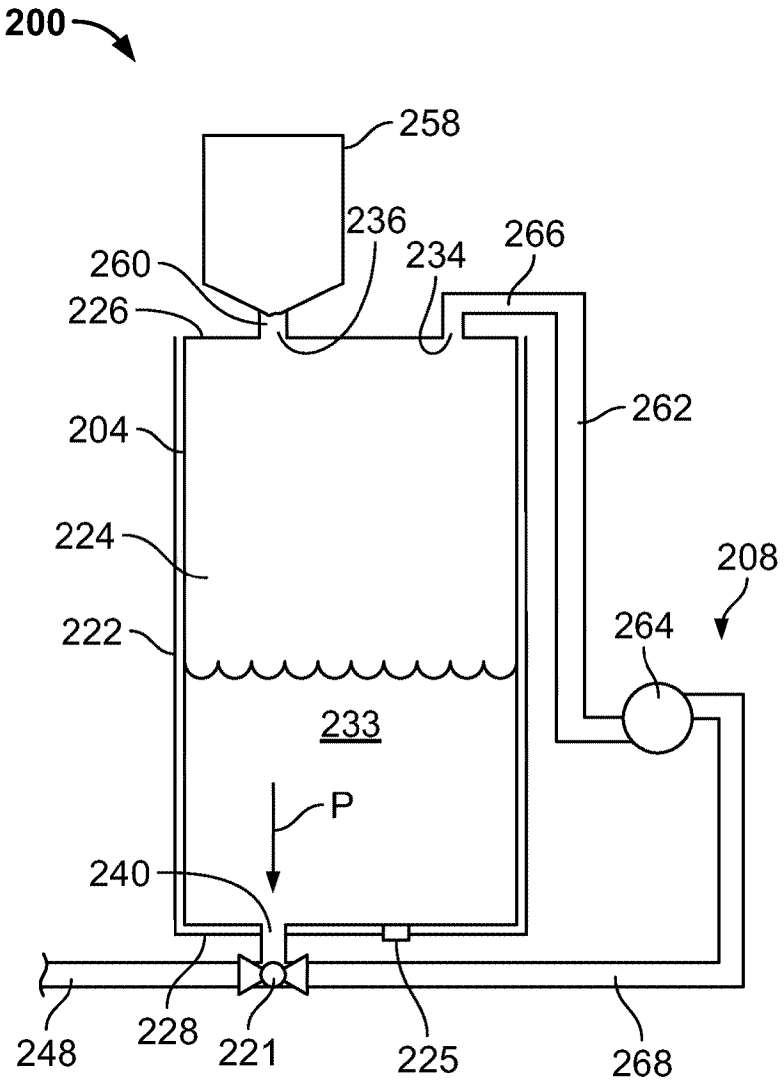
FIG. 5F illustrates the mixing system of FIG. 4 when the mixed solution of the mix bag is being drained.
Figure 5E:
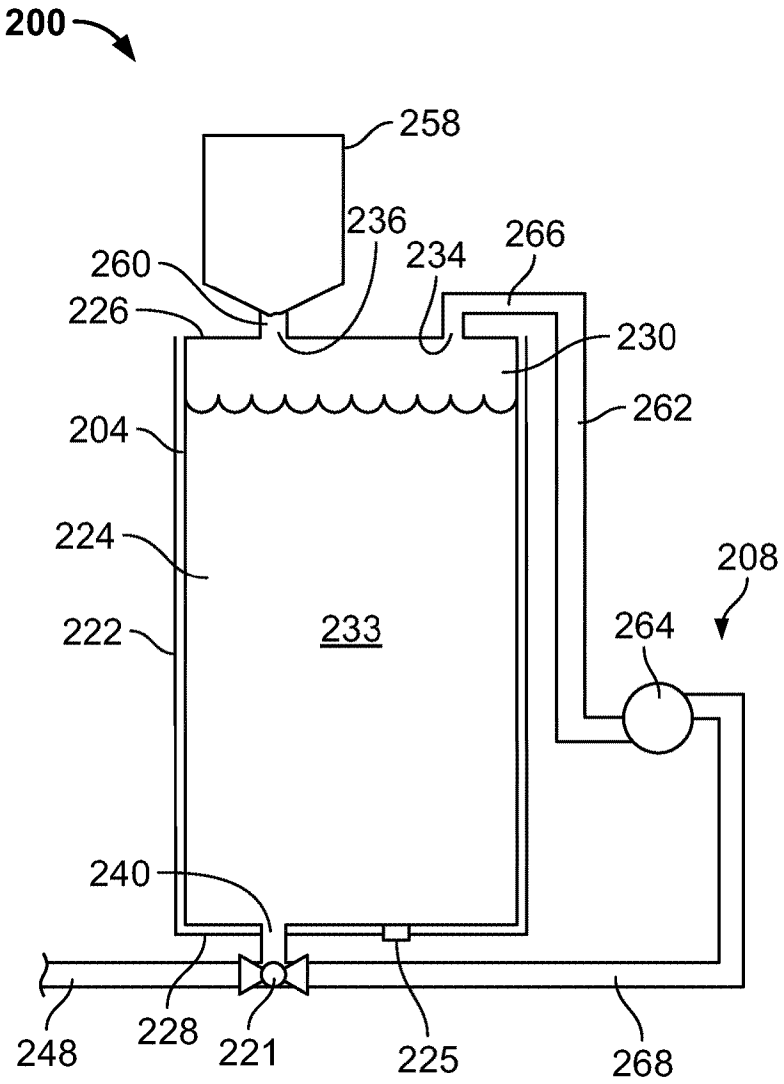
FIG. 5E illustrates the mixing system of FIG. 4 when the pump is discontinued and the mix bag contains a mixed solution.

In FIG. 5E, the recirculation assembly 208 is deactivated by discontinuing or shutting off the recirculation pump 264. At this point, the homogenous solution 233 may be sampled and tested for pH and concentration and then adjusted accordingly. To correct pH, for example, an additive, such as a pH adjusting agent, may be introduced by injecting the additive via a luer lock syringe at the bottom port 240. In FIG. 5F, the solution 233 is removed from the mix bag 204 when the valve 221 is opened to permit the solution 233 to flow in a P direction, opposite the F direction, through the bottom port 240. The valve 221 directs the drained solution 233 through the solvent line 248 for further processing, such as, for example, processing through a drain assembly which may include a filter sterilization system as depicted in the system 100 of FIG. 2. The solvent line 248 of the second system 200 may be coupled to a drain assembly, or a third valve, which couples the solvent line 248 and a drain line and controls the flow of solvent 246 into the mix bag 204 in step 18, and the flow of solution 233 out of the mix bag 204. In another example, a drain line may be connected to the mix bag 204 at a different port.

Figure 6B:
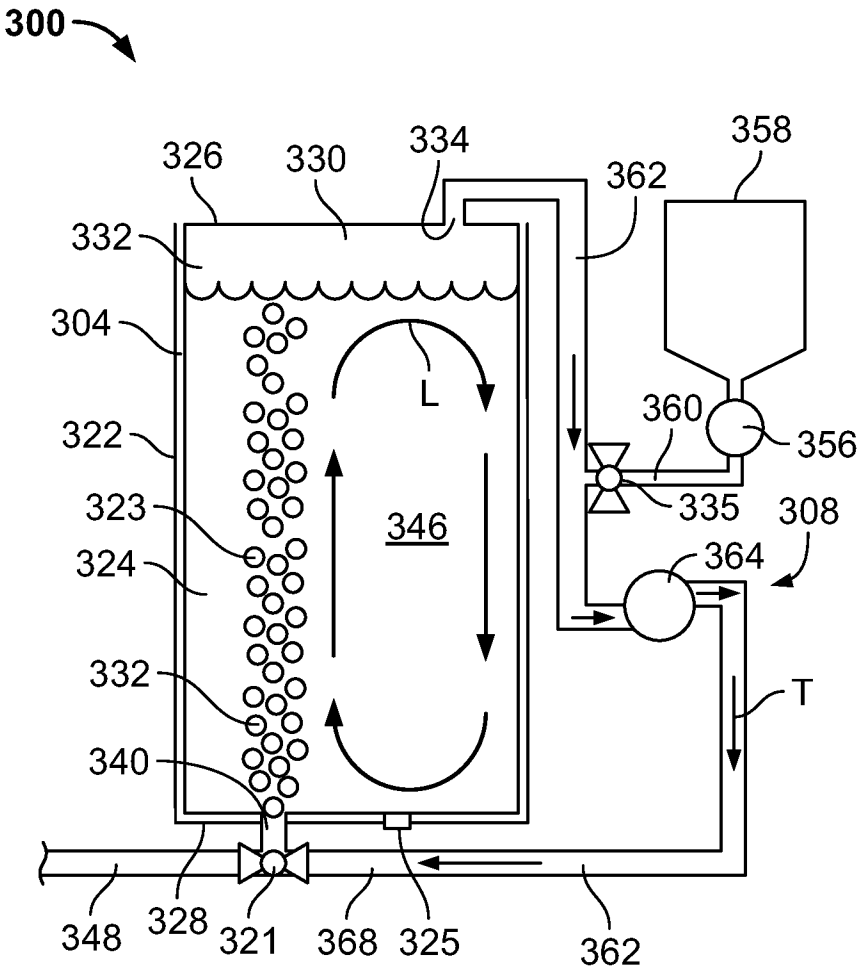
FIG. 6B illustrates the mixing system of FIG. 6A when a bubble column is established.
Figure 6A:
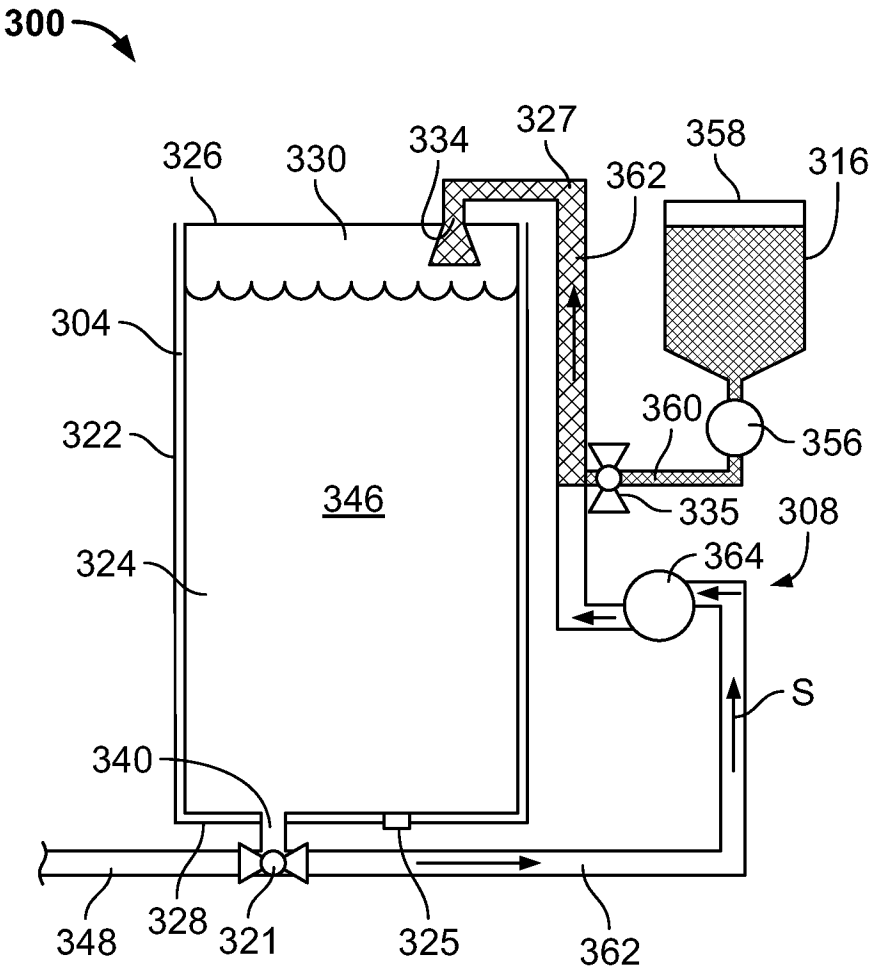
FIG. 6A is a schematic diagram of a mixing system for mixing a pharmaceutical solution according to the teachings of a third exemplary arrangement of the present disclosure, the mixing system having a third exemplary mix bag, a first pump, and a second pump.

Turning now to FIGS. 6A and 6B, a third exemplary mixing system 300 is constructed according to the teachings of the present disclosure. The mixing system 300 is arranged to perform at least one of the methods 10A-10D of FIGS. 1A-10D, and is therefore similar to the system 200 of FIGS. 4-5F. The system 300 includes a third exemplary mix bag 304, a second exemplary recirculation assembly 308, a solute assembly 316, and a solvent 346. For the third exemplary mixing system 300, the step 18 of filling the mix bag 304 with the solvent 346 includes pumping the solvent 346 through a bottom port 340 (i.e., the bottom gas circulation port) of the mix bag 304. Thus, for ease of reference, and to the extent possible, the same or similar components of the system 300 will retain the same reference numbers as outlined above with respect to the second system 200, although the reference numbers will be increased by 100. However, the third system 300 differs from the second system 200. In particular, the system 300 of FIGS. 6A and 6B is arranged to perform the steps of the third method variant 10C of FIG. 1C or the fourth method variant 10D of FIG. 1D. As compared to the first and second method variants 10A and 10B of FIGS. 1A and 1B, the step 22 of establishing a bubble column 323 in a mix bag 304 of methods 1C and 1D happens after the step 26 of adding a solute of the solute assembly 316 into the mix bag 304.

By comparison to the mix bag 104 of first system 100 and the mix bag 204 of the second system 200, the mix bag 304 of the third system 300 includes one bottom port 340 coupled to a first valve 321 and one top port 334 coupled to a second valve 335. The second valve 335 is coupled to a solute line 360 at a first intake and coupled to a connecting line 362 of the recirculation assembly 308 at a second intake of the valve 335. The second valve 335 is coupled to the solute line 360 and may be a rotary valve to control the flow of fluid (e.g., gas or liquid) through the connecting line 362 and into the mix bag 304 via the top port 334. The second valve 335 is operable in a first position or state, where the valve 335 fluidly couples (i.e., opens to permit fluid communication between) the solute line 360 and the connecting line 362. In a second position or state, the second valve 335 decouples (i.e., closes) the solute line 360 from the connecting line 362.

In FIG. 6A, the method step 14 of adding a gas 332 to the mix bag 304 and the method step 18 of adding the solvent 346 to the mix bag 304 has been performed, and an interior chamber 324 of the mix bag 304 contains the solvent 346, and the gas 332 is disposed in a headspace 330. While not illustrated, the connecting line 362 may be connected to an auxiliary air line or ambient air line to fill the mix bag 304 with gas. Additionally, FIG. 6A illustrates a recirculation pump 364 of a recirculation assembly 308 in an activated state. In the activated state, the recirculation pump 364 pulls solvent 346 from a bottom portion 328 of the mix bag 304 and through the bottom port 340, and pumps the solvent 346 into the connecting line 362 in a first direction S. The first valve 321 is in an open position to fluidly couple the interior chamber 324 of the mix bag 304 and a second end 368 of the connecting line 362, thereby permitting fluid (i.e., solvent 346) to flow through the bottom port 340. The second valve 335 is in a first position to permit fluid communication between the connecting line 362, the solute line 360, and the top port 334. As shown in FIG. 6A, the second valve 335 is open to permit the solute to mix with the solvent 346, forming a mixture 337, that flows through the top port 334 disposed in a top portion 326 of the mix bag 304. In a second open position, the second valve 335 closes or decouples the solute line 360 from the connecting line 362, and the connecting line 362 remains in fluid communication with the top port 334.

A second, or solute pump 356 of the system 300 is similar to the solvent pump 156 of the system 100 of FIG. 2 and is operably coupled to the solute line 360 to pump the solute to the interior chamber 324 of the mix bag 304 through the top port 334 when the second valve 335 is in the first position. In other words, the method step 26 of adding the solute to the mix bag 304 of the method 10A-10D includes operating the second pump 356. In this case, the solute is a liquid excipient, such as Dextrose. The solute mixes with the solvent 346 as a mixture 327 in the connecting line 362 is pumped into the mix bag 304. Both the recirculation pump 364 and the second pump 356 operate to pump the mixture 327 into the interior chamber 324 through the top port 334. However, in system 300 the solute line 360 is coupled to the connecting line 362 and the mixture 327 is delivered to the interior chamber 324 of the mix bag 304 through the first end 366 of the connecting line 362, rather than through the solvent line 148 of the first system 100 shown in FIG. 2. When the second valve 335 of the system 300 is in the first position and the first and second pumps 364, 356 are operating as shown in FIG. 6A, the solvent 346 flows through the recirculation assembly 308 in the S direction and mixes with the solute flowing through the solute line 360 and into the connecting line 362. The solute is thereby delivered into the mix bag 304 via the solute pathway 360, the connecting pathway 362, and the top port 334.

The recirculation pump 364 of the recirculation assembly 308 is reversible to pump fluid (e.g., liquid solvent 346) in the first direction S through the recirculation assembly 308, as shown in FIG. 6A, and also to pump fluid (e.g., gas 332) in a second direction T, opposite the first direction S, from the top portion 326 of the mix bag 304 to the bottom portion 328 of the mix bag 304, as shown in FIG. 6B. Therefore, the method steps 22 and 26 of the method 10A-10D performed by the system 300 includes an additional step of operating the recirculation pump 364 in the first direction S to perform method step 26 before reversing the recirculation pump 364 to operate in the second direction T to perform method step 22. FIG. 6B illustrates the system 300 performing the method step 22 of establishing a bubble column 323 in the mix bag 304 after completing the method step 26 of adding the solute to the mix bag 304. As shown, a solute bag 358 is empty, the second pump 356 is turned off, and the recirculation pump 364 is pumping gas 332 from the headspace 330 into the connecting line 362 in the second direction T. The system 300 mixes the added components in the interior chamber 304, and the second valve 335 is partially closed so the solute line 360 is closed off from the connecting line 362, and the connecting line 362 is coupled to both the top port 334 and the bottom port 340. In one example, the second pump 356 may produce an excipient flow rate of 100 mL/min, and the recirculation pump 364 may produce a recirculation flow rate of the solvent 364 at 4 L/min when adding the solute to the mix bag 304. To establish the bubble column 323, the recirculation flow rate may produce gas flow at a flow rate setting of 6 and 19 liters per minute.

Any of the disclosed first, second, and third systems 100, 200, 300 may include a process control system including a workstation, a controller, and communication lines to control each assembly and component of the operation of systems 100, 200, 300. The controller may be programmed to store each method variant 10A, 10B, 10C, or 10D of FIGS. 1A-1D in a memory, and also configured to run each method when an input is received at the workstation. The controller may collect information measured by one or more sensors and output devices, such as, for example, thermometers, pressure gauges, concentration gauges, fluid level meters conductivity meters, flow meters, etc., that may be incorporated throughout the system 100, 200, 300.

Figure 7:
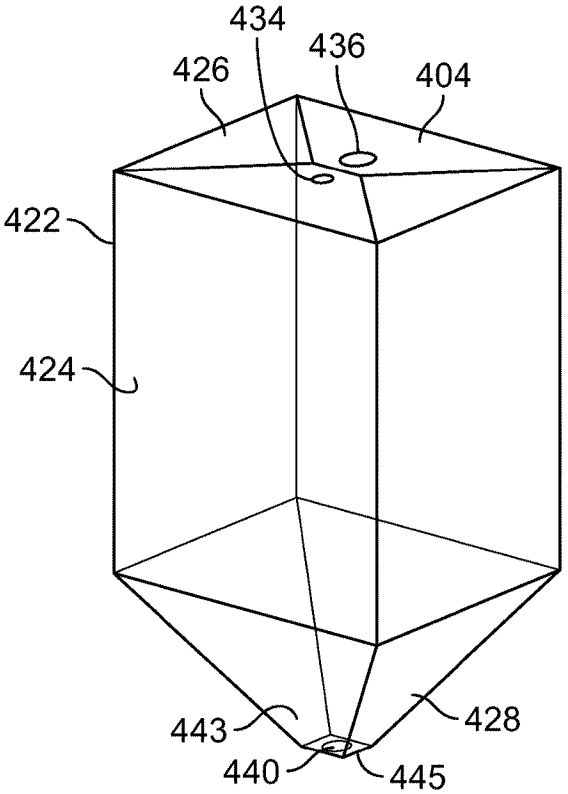
FIG. 7 is a perspective view of a mix bag for use with a mixing system according to the teachings of a fourth exemplary mix bag of the present disclosure.

In FIG. 7, a fourth exemplary mix bag 404 is constructed according to the teachings of the present disclosure. The fourth exemplary mix bag 404 is similar to the previously described mix bags 104, 204, 304, and thus, for ease of reference, and to the extent possible, the same or similar components of the mix bag 404 will retain the same reference numbers as outlined above with respect to the first bag 104, although the reference numbers will be increased by 300. While the mix bag 404 includes first and second top ports 434, 436 and a bottom port 440, the fourth exemplary mix bag 404 may have any number of different port arrangements, and therefore may be configured specifically for use in any one of the mixing systems 100, 200, 300 or other systems. The fourth exemplary mix bag 404 differs from mix bags 104, 204, and 304 in the manner discussed below.

A bottom portion 428 of the mix bag 404 has tapered bottom shape 445 such that a plurality of walls 422 of the mix bag 404 slope inwardly at the bottom portion 428 of the mix bag 404. In the illustrated example, the mix bag 404 is generally cubical and the tapered shape 445 is angled (e.g., 45 degrees or more relative to walls 422 of the mix bag 404) to form an inverted pyramid. The tapered shape 445 encourages settling of non-dissolved solute or of a dense portion of a solute-solvent mixture towards a narrow volume 443 of an interior chamber 424 of the mix bag 404. The inverted pyramid shape 445 of the bottom portion 428 facilitates mixing by providing funnel functionality. In this example, the bottom port 440 is disposed in the tapered shape 445 (e.g., tip) of the bottom portion 428. Thus, when a bubble column is established in the mix bag 404, the bubble column would be shaped by the tapered shape 445 of the mix bag 404. The uprising entrained liquid solvent may be proximally replenished by a solution flowing downwards in the effective funnel of the inverted pyramid shape 445. Other suitable shapes and configurations may be achieved, such as, for example, conical, cylindrical, and other prismatic shapes. It is understood that the first, second, third, and four exemplary mix bags 104, 204, 304, 404 of the present disclosure may have any number of variations in terms of port arrangements, including number of ports and location of each port relative to each other and to the walls of the mix bag 104, 204, 304, 404.

Figure 8:
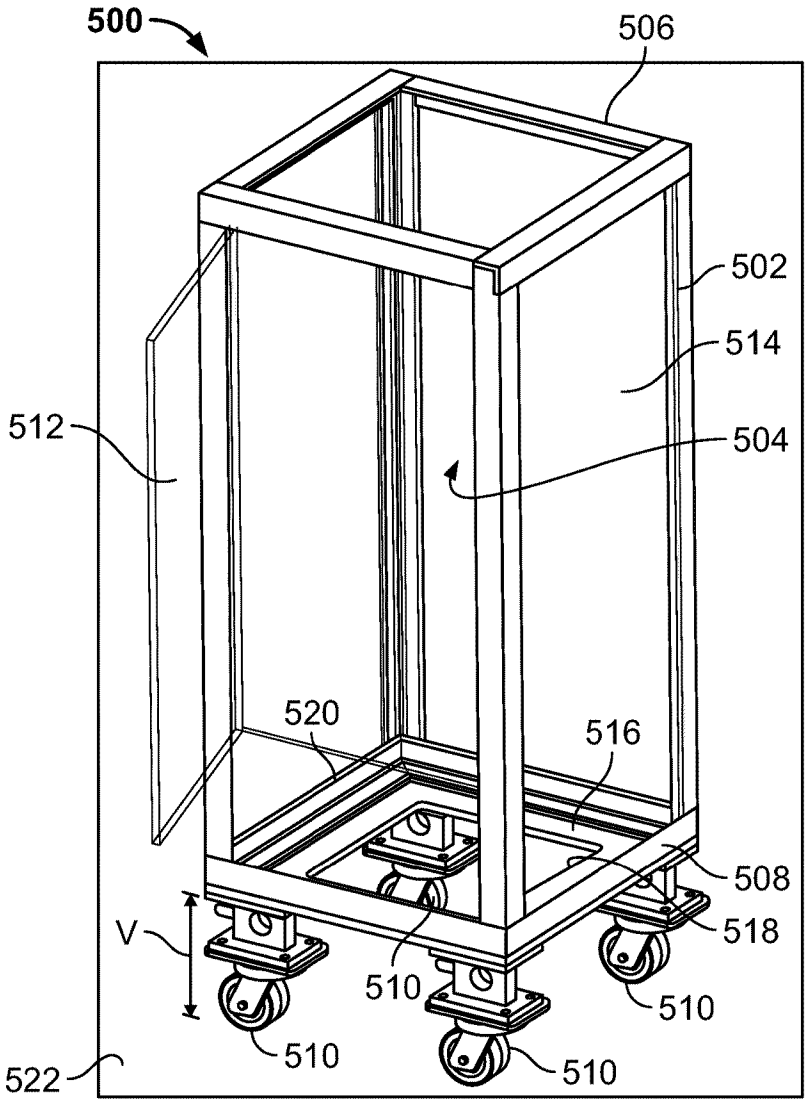
FIG. 8 is a perspective view of a tank for supporting a mix bag of a mixing system according to the teachings of the present disclosure.

In FIG. 8, a mix bag tank 500 for holding a mix bag, such as any one of the mix bags 104, 204, 304, and 404 described herein, is constructed in accordance with the teachings of the present disclosure. The tank 500 has a rectangular frame 502 which defines an interior cavity 504, an open top end 506, and a bottom end 508. A plurality of wheels 510 are mounted to the bottom end 508 of the frame 502 to provide mobility for any of the disclosed systems 100, 200, 300. The tank 500 includes a door 512 hingedly coupled to the frame 502 and transparent walls 512 or windows which further define the interior cavity 504. The walls 512 and the frame 502 provide a rigid support structure for the disposable mix bags 104, 204, 304, 404, which, when empty, do not have a rigid self-supporting structure. In particular, the bottom end 508 has a support surface 516 to engage the bottom portion 128, 228, 328 of the mix bag 104, 204, 304, 404 to keep the mix bag 104, 204, 304, 404 from falling through the frame 502. The frame 502 is structured to support each mix bag 104, 204, 304, 404 in an upright position, and may include fixtures to support the recirculation assembly 108, 208, 308 of the system 100, 200, 300. In the upright position, the top portion 126, 226, 326, 426 of each mix bag 104, 204, 304, 404 may be in proximity to the open top end 506 of the frame 502. Alternatively, the tank 500 may be disposed in, or surrounded by, a framed structure that supports a variety of solutes and solvents and suspends the solutes and solvents above the mix bag 104, 204, 304, 404.

The top end 506 is open to allow one or more of the top ports of the bag 104, 204, 304, 404 to couple with other components of the system 100, 200, 300, for example, the recirculation assembly 108, 208, 308 (via the connecting line 162, 262, 362) and the solute assembly 116, 216, 316 (via the solute line 160, 260, 360) of the first, second, and third systems 100, 200, 300, or the solvent assembly 112 of the first system 100. Additionally, the bottom end 508 has an opening 518 to allow one or more bottom ports of the bag 104, 204, 304, 404 to couple with other components of the systems 100, 200, 300, for example, the recirculation assembly 108, 208, 308 (via the connecting line 162, 262, 362), the solvent line 248, 348 of the second and third systems 200, 300, or the drain assembly 120 (via the drain line 178) of the first system 100. The opening 518 may also provide space for a tapered portion of a mix bag, such as the inverted pyramid shape 445 of the bottom end 428 of the bag 404 of FIG. 7, to extend beyond the bottom end 508 of the frame 502. A load cell or scale may be positioned within the interior cavity 504 of the frame 502 (e.g., attached to the bottom end 508), beneath the opening 518 of the bottom end 508, or the entire mix bag 104, 204, 304, 404 and frame 502 may sit on a weigh scale. The door 512 of the tank 500 provides access to the front face (e.g., the front wall 122*a* in FIGS. 3A-3C) of the mix bag 104, 204, 304, 404. The door does not extend the entire height of the frame 502, and a lower wall 520 extends from the bottom end 508 of the frame 502 to the door 512. The lower wall 520 may provide additional support for the mix bag 104, 204, 304, 404, and may facilitate positioning of the mix bag 104, 204, 304, 404 within the interior cavity 504 of the tank 500. The bottom end 508 is spaced a distance J from a floor or support surface 522 by the wheels 510. The distance J may be adjustable by raising or lowering the bottom end 508 of the tank 500.

Figure 9C:
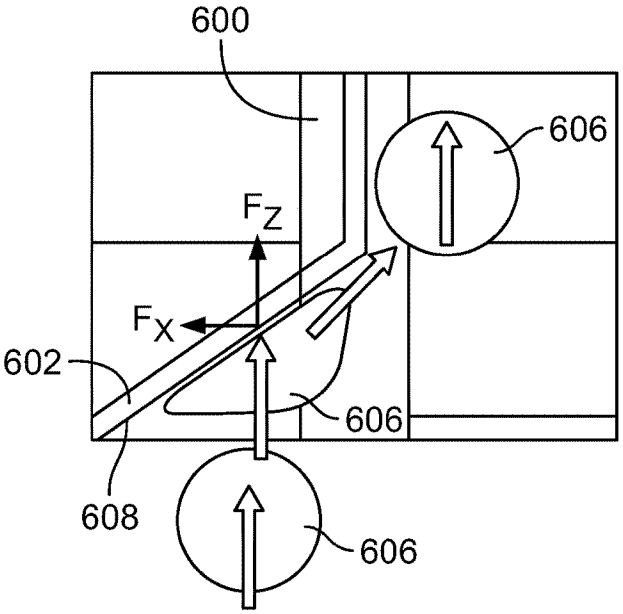
FIG. 9C is a force diagram of the impeller assembly of FIG. 9A in a mixing system according to the teachings of the present disclosure.
Figure 9A:
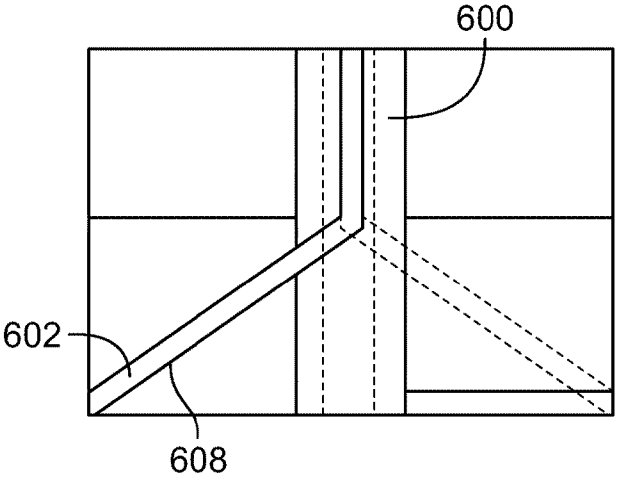
FIG. 9A is a side view of an impeller assembly for use with a mixing system according to the teachings of the present disclosure.
Figure 9B:
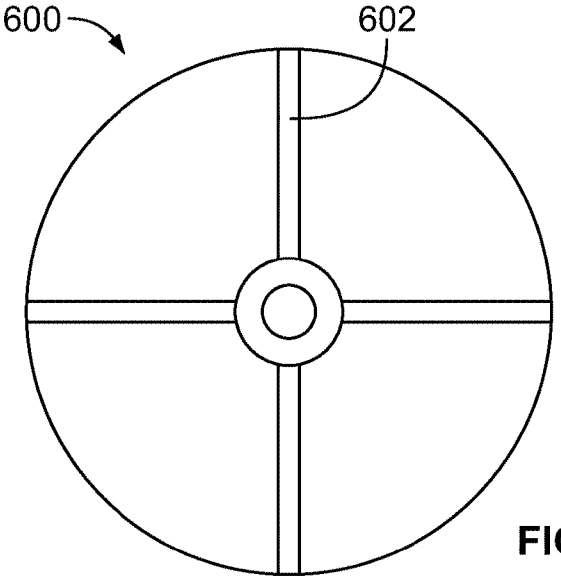
FIG. 9B is a top view of the impeller assembly of FIG. 9A.

FIGS. 9A-9C illustrate a free-spinning impeller 600 constructed according to the teachings of the present disclosure. The impeller 600 may be added to an interior chamber 124, 224, 324, 424 of any one of the mix bags 104, 204, 304, 404 to augment mixing within a bottom portion 128, 228, 328, 428 of the mix bag 104, 204, 304, 404. The impeller 600 includes a plurality of blades 602, where one or more of the blades 602 are optimized to spin by the upward travel of bubbles of a bubble column moving from below a portion of the impeller, thereby rotating the impeller 600 and adding a radial mixing feature at the bottom portion of the mix bag. In FIG. 9C, a bubble 606 is released under the impeller blade 602, and interacts with an angled surface 608 of the blade 602. A horizontal force $F_X$ provides a torque load to spin the impeller blade 602.

Figure 10:
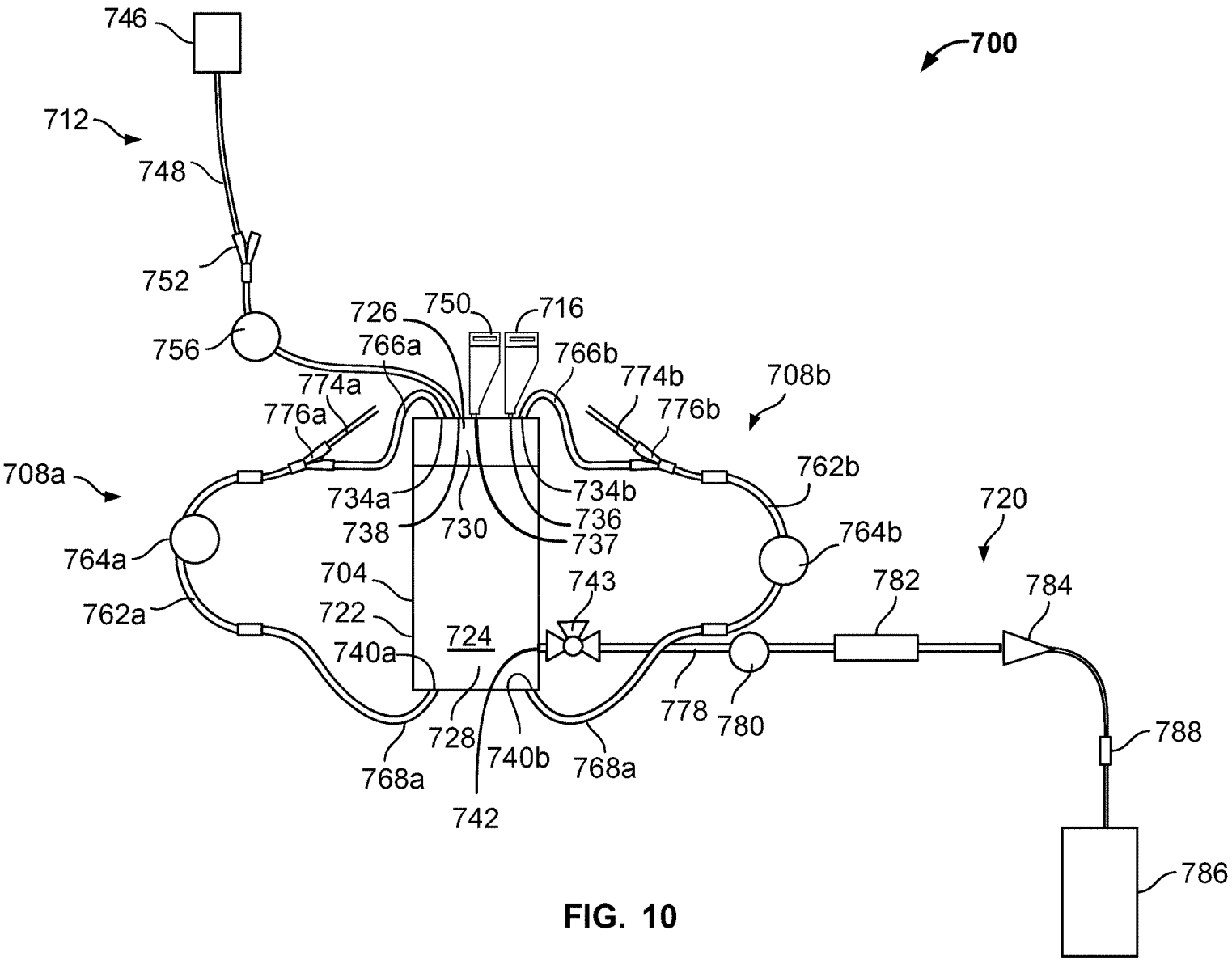
FIG. 10 is a schematic diagram of a mixing system for mixing a pharmaceutical solution according to the teachings of another exemplary arrangement of the present disclosure.

FIG. 10 illustrates another exemplary bubble agitation system 700 constructed in accordance with the teachings of the present disclosure. The system 700 performs at least one of the methods 10A-10D of FIGS. 1A-1D, and is similar to the system 100 of FIG. 2. The system 700 includes a fifth exemplary mix bag 704 operably coupled to a first recirculation assembly 708*a*, a second recirculation assembly 708*b*, a solute assembly 716 containing an API, a container 750 containing an excipient, a solvent assembly 712, and a downstream assembly 720. Thus, for ease of reference, and to the extent possible, the same or similar components of the system 700 will retain the same reference numbers as outlined above with respect to the first system 100, although the reference numbers will be increased by 600.

Unlike the mix bag 104 of the first exemplary system 100, the mix bag 704 of the system 700 of FIG. 10 includes five top ports 734*a*, 734*b*, 736, 737, 738, two bottom ports 740*a*, 740*b*, and a side drain port 742 disposed adjacent to the bottom portion of the bag 704. The side drain port 742 is coupled to a valve 743, such as a three-way stopcock valve, which permits an operator to access the solution for sample extraction, to introduce additives via a luer lock syringe, and to drain the solution from the bag 704. Two top ports 734*a*, 734*b* and two bottom ports 740*a*, 740*b* are gas recirculation ports and fluidly couple an interior compartment 724 of the mix bag 704 to the first and second recirculation assemblies 708*a*, 708*b*. A third top port 738 fluidly couples a solvent line 748 to the interior compartment 724 of the mix bag 704. In this example, a solvent 746 may be filtered water that is disposed directly into the bag 704 through the solvent line 748. The solvent line 748 includes a Y connector 752 that is configured to couple to a liquid excipient, such as the excipient 150 as shown and described in FIG. 2. However, in the example illustrated in FIG. 10, a liquid excipient is not coupled to the solvent line 748, and instead, a container 750 providing a powder excipient is coupled to the mix bag 704. A first solute port 736 couples the solute assembly 716 to the interior compartment 724 and a second solute port 737 couples the container 750 of excipient to the interior compartment 724. In this example, both the excipient and the API are in powder form and may be clamped to permit pre-assembly of each product bag (containing the API and excipient) to the mix bag 704 prior to performing method steps 14 or 18 of the method 10A-10D. For example, in method step 18, filter water may be added to the mix bag 104 and then the container 750 may be unclamped, releasing the excipient into the interior compartment 724 of the mix bag 704 to mix with the filtered water to form a solvent. Method step 26 may include unclamping the API of the solute assembly 716, and releasing a solute into the interior compartment 724 of the mix bag 704.

The system 700 also differs from the previous systems by providing first and second recirculation assemblies 708*a*, 708*b*. Method step 14 of the method 10A-10D of FIGS. 1A-1D includes operating each assembly 708*a*, 708*b* to provide gas into the interior compartment 724 of the mix bag 704. Each recirculation assembly 708*a*, 708*b* includes a pump 764*a*, 764*b*, such as a peristaltic pump, coupled to a connection line 762*a*, 762*b*. Each connection line 762*a*, 762*b* is attached to top and bottom portions 726, 728 of the mix bag 704 and coupled to a gas source, such as a Nitrogen tank (not shown). Each connection line 762*a*, 762*b* includes a first end 766*a*, 766*b* coupled to top ports 734*a*, 734*b*, respectively, and a second end 768*a*, 768*b* coupled to bottom ports 740*a*, 740*b*, respectively. Additionally, each connection line 762*a*, 762*b* is coupled to an auxiliary air line 774*a*, 774*b* at a Y-connector 776*a*, 776*b*. Each auxiliary air line 774*a*, 774*b* is fluidly coupled to a Nitrogen gas tank, or in another example, the auxiliary air lines 774*a*, 774*b* of each connection line 762*a*, 762*b* is coupled to the same Nitrogen gas tank. While the mix bag 104 is being filled with Nitrogen gas, the first end 766*a*, 766*b* of each connecting line 762*a*, 762*b* is clamped off from the gas source allowing the gas to flow into the bottom ports 740*a*, 740*b* of the mix bag 704 to create a headspace 730.

The disclosed systems and methods provide a number of advantages over known mixing systems and methods. For example, single-use mix bags 104, 204, 304, 404, 704 for bubble mixing systems may be much simpler to assemble, operate, and manufacture than containers having mechanical mixing devices. The mix bag 104, 204, 304, 404, 704 of the present disclosure eschews solid dynamic mechanical components thereby eliminating extra cost due to additional materials, mechanisms, complexity, and potential particulate matter generation. Additionally, the mix bags 104, 204, 304, 404, 704 may be easier to ship because the mix bags 104, 204, 304, 404, 704 of the present disclosure do not include rigid internal hardware components that could present a risk of rubbing or piercing walls of the mix bags 104, 204, 304, 404, 704 during shipment. With no such hardware, the bubble mixing single use mix bags 104, 204, 304, 404, 704 are more reliable for shipping. The single-use mix bags 104, 204, 304, 404, 704 at a minimum have a top port for processing additions and a bottom port for drawing off results. The bubble mixing systems 100, 200, 300, 700 do not require additional ports to the mix bag that would otherwise be required to operate the mechanical mixing devices of known mix bags, thereby reducing costs of material, complexity in manufacturing and assembly, and necessary steps for ensuring the system remains closed.

In known mixing systems, gas bubble streams are commonly used for "sparging" processes. Sparging is a mass transfer technique whereby cell cultures in bioreactors are appropriately aerated, gas components are added to the solution, or the gas bubble stream strips material out of the solution to minimize or eliminate the presence of a processing substance. Typical sparging operations need fresh gas supplied by a compressed gas source, either from gas cylinders or a facilities supply, which are costly to operate. Because the bubble mixing system can be configured to recirculate from the headspace, far less gas is consumed as compared to a non-renewing source. Therefore, manufacturing and operating a bubble mixing system 100, 200, 300 of the present disclosure may be less costly and more reliable than conventional systems.

Additionally, a fresh gas source for sparging is intentionally reactive with the solution contents. Incidental reactivity, however, is generally not advisable when blending pharmaceuticals, such as pharmaceutical solutions produced by the systems 100, 200, 300, 700 described herein. By limiting the gas source to the headspace of the single-use mix bag of the present disclosure, the reactive content of the bubbling gas is limited by equilibrium to a lower overall system potential reactivity when compared to a fresh gas source like sparging. For exceptionally sensitive materials only small amounts of an inert gas, e.g., Nitrogen, may be used in the headspace as the renewable bubble gas source. Another advantage of the bubble mixing systems 100, 200, 300, 700 of the present disclosure is that by their buoyant nature, the bubbles always provide agitation up to and into the top surface regardless of rate of the bubble column. Mechanical systems of known mixing processes typically need to be run at escalating energy to get a surface disruption. Upper surface energy is important when mixing floating/clumping ingredients like Vancomycin, and over energizing the entirety of the system to make this happen by mechanical agitation devices may not always be optimal.

In view of the foregoing, it should be appreciated that the various embodiments described herein provide examples of various devices, systems, and methods constructed in accordance with the principles of the present disclosure. These embodiments are not meant to be exclusive embodiments, but rather, any of the embodiments can be modified to include any one or more features of any of the other embodiments. As such, it should be appreciated that the examples provided herein are not exhaustive and the various features are interchangeable with each other, as well as with features not specifically disclosed but understood by a person having ordinary skill in the art.

What is claimed:

1. A bubble agitation system for mixing a pharmaceutical solution, the system comprising:

a mix bag including one or more walls defining an interior chamber having a top portion and a bottom portion opposite the top portion;

a top gas recirculation port extending into the top portion of the interior chamber through the one or more walls of the mix bag;

a bottom gas recirculation port extending into the bottom portion of the interior chamber through the one or more walls of the mix bag;

a solvent pathway coupled to the interior chamber of the mix bag and configured to deliver a solvent into the mix bag;

a solute pathway coupled to the interior chamber of the mix bag and configured to deliver a solute into the mix bag; and a recirculation assembly including a connecting pathway and a recirculation pump operably coupled to the connecting pathway, the connecting pathway having a first end coupled to the top gas recirculation port and a second end coupled to the bottom gas recirculation port;

wherein the recirculation pump engages the connecting pathway to pull gas from a headspace disposed adjacent to the top portion of the mix bag and deliver gas through the connecting pathway and into the bottom portion of the mix bag via the bottom gas recirculation port a solute port coupled to the solute pathway, the solute port extending into the top portion of the interior chamber and through the one or more walls of the mix bag;

wherein the solute port is in substantial axial alignment with the bottom gas recirculation port.

2. The system of claim 1, wherein the connecting pathway is in fluid communication with the headspace via the top gas recirculation port, and at least one of the connecting pathway and the bottom gas recirculation port is configured to discharge gas drawn from the headspace into the bottom portion of the mix bag to form a bubble column.

3. The system of claim 1, further comprising an air filter coupled to an ambient air pathway, the ambient air pathway coupled to the connecting pathway of the recirculation assembly.

4. The system of claim 1, further comprising an auxiliary air pathway coupled to the connecting pathway of the recirculation assembly, the auxiliary air pathway coupled to a gas tank.

5. The system of claim 1, further comprising:

a second recirculation assembly including a connecting pathway and a recirculation pump operably coupled to the connecting pathway of the second recirculation assembly; and a second top recirculation port and a second bottom recirculation port;

wherein the connecting pathway of the second recirculation assembly is coupled to the second top recirculation port at a first end and coupled to the second bottom recirculation port at a second end.

6. The system of claim 1, further comprising:

an excipient pathway coupled to the solvent pathway and configured to deliver an excipient into the solvent pathway; and a pump operably coupled to at least one of the excipient pathway and the solvent pathway;

wherein the pump is configured to deliver the excipient and the solvent into the mix bag through the solvent pathway.

7. A bubble agitation system for mixing a pharmaceutical solution, the system comprising:

a mix bag including one or more walls defining an interior chamber having a top portion and a bottom portion opposite the top portion;

a top gas recirculation port extending into the top portion of the interior chamber through the one or more walls of the mix bag;

a bottom gas recirculation port extending into the bottom portion of the interior chamber through the one or more walls of the mix bag;

a solvent pathway coupled to the interior chamber of the mix bag and configured to deliver a solvent into the mix bag:

a solute pathway coupled to the interior chamber of the mix bag and configured to deliver a solute into the mix bag; and a recirculation assembly including a connecting pathway and a recirculation pump operably coupled to the connecting pathway, the connecting pathway having a first end coupled to the top gas recirculation port and a second end coupled to the bottom gas recirculation port;

wherein the recirculation pump engages the connecting pathway to pull gas from a headspace disposed adjacent to the top portion of the mix bag and deliver gas through the connecting pathway and into the bottom portion of the mix bag via the bottom gas recirculation port an excipient pathway coupled to the solvent pathway and configured to deliver an excipient into the solvent pathway; and a pump operably coupled to at least one of the excipient pathway and the solvent pathway;

wherein the pump is configured to deliver the excipient and the solvent into the mix bag through the solvent pathway;

a valve operably coupled to the bottom gas recirculation port to control fluid flow through the bottom gas recirculation port, the valve operably coupled to the solvent pathway and the connecting pathway of the recirculation assembly;

wherein the pump is configured to deliver the excipient and the solvent into the mix bag through the bottom gas recirculation port.

8. The system of claim 6, further comprising:

a solvent port coupled to the solvent pathway, the solvent port extending into the top portion of the interior chamber and through the one or more walls of the mix bag;

wherein the pump is configured to deliver the excipient and the solvent through the solvent port.

9. The system of claim 1, further comprising a solute pump operably coupled to the solute pathway to deliver the solute to the top portion of the interior chamber of the mix bag.

10. A bubble agitation system for mixing a pharmaceutical solution, the system comprising:

a mix bag including one or more walls defining an interior chamber having a top portion and a bottom portion opposite the top portion;

a top gas recirculation port extending into the top portion of the interior chamber through the one or more walls of the mix bag;

a bottom gas recirculation port extending into the bottom portion of the interior chamber through the one or more walls of the mix bag;

a solvent pathway coupled to the interior chamber of the mix bag and configured to deliver a solvent into the mix bag;

a solute pathway coupled to the interior chamber of the mix bag and configured to deliver a solute into the mix bag; and a recirculation assembly including a connecting pathway and a recirculation pump operably coupled to the connecting pathway, the connecting pathway having a first end coupled to the top gas recirculation port and a second end coupled to the bottom gas recirculation port;

wherein the recirculation pump engages the connecting pathway to pull gas from a headspace disposed adjacent to the top portion of the mix bag and deliver gas through the connecting pathway and into the bottom portion of the mix bag via the bottom gas recirculation port; and a solute pump operably coupled to the solute pathway to deliver the solute to the top portion of the interior chamber of the mix bag;

wherein the solute pathway is coupled to the connecting pathway, the connecting pathway configured to deliver the solute into the mix bag via the top gas recirculation port.

11. The system of claim 10, further comprising a valve operably coupled to the top gas recirculation port to control fluid flow through the top gas recirculation port, the valve configured to fluidly couple the solute pathway to the connecting pathway in a first position and fluidly decouple the solute pathway from the connecting pathway in a second position, such that when the valve is in the first position the solute pump is operable to cause the solute to reach the mix bag via the solute pathway, the connecting pathway, and the top gas recirculation port.

12. The system of claim 1, wherein the one or more walls of the mix bag is sloped inward forming a tapered bottom, the bottom gas recirculation port adjacent to the tapered bottom.

13. The system of claim 1, wherein the interior chamber of the mix bag includes a sterile environment, and the recirculation assembly is configured to maintain the sterile environment of the interior chamber of the mix bag.

14. The system of claim 1, wherein the mix bag includes a solvent port coupled to a solvent source, the solvent port configured to deliver the solvent into the interior chamber of the mix bag.

15. The system of claim 1, wherein the mix bag includes a excipient port coupled to a container containing an excipient, the excipient port configured to deliver the excipient into the interior chamber of the mix bag.

16. The system of claim 1, wherein the recirculation pump of the recirculation assembly is reversible to pump fluid in a first direction from the bottom portion of the mix bag to the top portion of the mix bag, and configured to pump gas in a second direction from the top portion of the mix bag to the bottom portion of the mix bag to form a bubble column.

17. The system of claim 1, further comprising a drain port extending into the interior chamber and through the one or more walls of the mix bag.

18. The system of claim 17, further comprising at least one of:

a downstream assembly coupled to the drain port, the downstream assembly including a pump and a filter; or a three-way valve coupled to the drain port.

19. The system of claim 1, wherein the bottom gas recirculation port is used as a drain port to drain contents of the mix bag.

20. The system of claim 19, further comprising at least one of: a downstream assembly coupled to the drain port, the downstream assembly including a pump and a filter; or a three-way valve coupled to the drain port.

21. The system of claim 1, further comprising a free-spinning impeller mechanism disposed within the bottom portion of the interior chamber of the mix bag.

22. The system of claim 1, further comprising a movable frame sized to receive the mix bag.

23. The system of claim 1, wherein the recirculation pump is a peristaltic pump.

24. The system of claim 1, wherein the bottom gas recirculation port has an inner diameter in a range of approximately 0.20 inches to approximately 0.5 inches.

* * * * *